US011498190B2

(12) United States Patent
Kamiya

(10) Patent No.: US 11,498,190 B2
(45) Date of Patent: Nov. 15, 2022

(54) POWER TOOL

(71) Applicant: MAKITA CORPORATION, Anjo (JP)

(72) Inventor: Takeshi Kamiya, Anjo (JP)

(73) Assignee: MAKITA CORPORATION, Anjo (JP)

( * ) Notice: Subject to any disclaimer, the term of this patent is extended or adjusted under 35 U.S.C. 154(b) by 283 days.

(21) Appl. No.: 16/728,094

(22) Filed: Dec. 27, 2019

(65) Prior Publication Data

US 2020/0238483 A1 Jul. 30, 2020

(30) Foreign Application Priority Data

Jan. 28, 2019 (JP) ..... JP2019-012418

(51) Int. Cl.
*B25B 21/02* (2006.01)
*B25D 16/00* (2006.01)

(52) U.S. Cl.
CPC ..... *B25B 21/026* (2013.01); *B25B 21/023* (2013.01); *B25D 16/003* (2013.01); *B25D 16/006* (2013.01); *B25D 2216/0084* (2013.01)

(58) Field of Classification Search
CPC ... B25B 21/026; B25B 21/023; B25D 16/003; B25D 16/006; B25D 2216/0084
See application file for complete search history.

(56) References Cited

U.S. PATENT DOCUMENTS 6,892,827 B2 * 5/2005 Toyama ..... B25D 16/006 173/48
7,513,845 B2 * 4/2009 Ho ..... B25B 21/008 475/298
7,882,899 B2 * 2/2011 Borinato ..... B25F 5/001 173/179
7,980,324 B2 * 7/2011 Bixler ..... B25F 5/001 173/176
2005/0150669 A1 * 7/2005 Umemura ..... B25B 21/00 173/48

(Continued)

FOREIGN PATENT DOCUMENTS

JP 2008-531310 A 8/2008
JP 2017-100259 A 6/2017

OTHER PUBLICATIONS

Aug. 23, 2022 Office Action issued in Japanese Patent Application No. 2019-012418.

*Primary Examiner* — Eyamindae C Jallow
*Assistant Examiner* — Himchan Song
(74) *Attorney, Agent, or Firm* — Oliff PLC

(57) ABSTRACT

A power tool allows mode switching and clutch operation torque switching using a single ring. An electric vibration driver drill includes an internal gear that meshes with planetary gears, an internal gear lock pin that moves forward relative to the internal gear to lock the internal gear, a first vibration cam fixed to a spindle, a second vibration cam that rubs against the first vibration cam and rotate relative to a gear housing, a vibration switch lever that moves forward relative to the second vibration cam to lock the second vibration cam in a nonrotatable manner, and an annular change ring that switches between forward movement and rearward movement of the internal gear lock pins and switches between forward movement and rearward movement of the vibration switch lever.

12 Claims, 21 Drawing Sheets

(56) References Cited

U.S. PATENT DOCUMENTS

| | | | | |
|---|---|---|---|---|
| 2006/0086514 | A1* | 4/2006 | Aeberhard | B25B 21/023 173/48 |
| 2006/0210688 | A1 | 9/2006 | Mower | |
| 2010/0200257 | A1* | 8/2010 | Scrimshaw | B27B 5/32 74/423 |
| 2012/0031637 | A1* | 2/2012 | Yin | B25F 5/006 173/47 |
| 2012/0037388 | A1* | 2/2012 | Yin | B25B 21/02 173/47 |
| 2012/0255754 | A1* | 10/2012 | Kondo | B25D 11/102 173/178 |
| 2017/0157753 | A1* | 6/2017 | Nagasaka | B23B 45/00 |
| 2017/0252915 | A1* | 9/2017 | Furusawa | B25D 11/062 |

* cited by examiner

POWER TOOL

CROSS-REFERENCE TO RELATED APPLICATIONS

This application claims the benefit of priority to Japanese Patent Application No. 2019-012418, filed on Jan. 28, 2019, the entire contents of which are hereby incorporated by reference.

BACKGROUND

1. Technical Field

The present invention relates to a power tool such as an electric vibration driver drill or an electric vibration drill.

2. Description of the Background

A known electric vibration driver drill includes a mode change ring 82 and a change ring 86, as described in Japanese Unexamined Patent Application Publication No. 2017-100259.

The mode change ring 82 switches between a drill mode, a clutch mode, and a vibration mode by changing its rotational position. In the drill mode, a clutch and a vibration mechanism do not operate. In the clutch mode, the clutch operates, but the vibration mechanism does not operate. In the vibration mode, the clutch does not operate, but the vibration mechanism operates.

The change ring 86 switches the torque for operating the clutch by changing its rotational position.

BRIEF SUMMARY

One or more aspects of the present invention are directed to a power tool that allows mode switching and clutch operation torque switching with a single ring.

A first aspect of the present invention provides a power tool, including:

a motor;

a sun gear driven by the motor;

a planetary gear driven by the sun gear;

an internal gear meshing with the planetary gear;

an internal gear lock pin movable forward and rearward relative to the internal gear and configured to lock the internal gear in a nonrotatable manner at a forward position;

a spindle driven by the planetary gear;

a gear housing accommodating the planetary gear;

a first vibration cam fixed to the spindle;

a second vibration cam configured to rub against the first vibration cam and rotatable relative to the gear housing;

a vibration switch member movable forward and rearward relative to the second vibration cam and configured to lock the second vibration cam in a nonrotatable manner at a forward position; and an annular change ring configured to switch between forward movement and rearward movement of the internal gear lock pin and to switch between forward movement and rearward movement of the vibration switch member.

A second aspect of the present invention provides a power tool, including:

a motor;

a sun gear driven by the motor;

a planetary gear driven by the sun gear;

an internal gear meshing with the planetary gear;

a clutch pin elastic member;

a clutch pin configured to come in contact with the internal gear when urged by the clutch pin elastic member to retain the internal gear in a nonrotatable manner in accordance with an urging force of the clutch pin elastic member;

an elastic member holder holding the clutch pin elastic member to allow the clutch pin elastic member to generate a variable urging force;

a spindle driven by the planetary gear;

a gear housing accommodating the planetary gear;

a first vibration cam fixed to the spindle;

a second vibration cam configured to rub against the first vibration cam and rotatable relative to the gear housing;

a vibration switch member movable forward and rearward relative to the second vibration cam and configured to lock the second vibration cam in a nonrotatable manner at a forward position; and an annular change ring configured to switch the urging force of the clutch pin elastic member held by the elastic member holder and to switch between forward movement and rearward movement of the vibration switch member.

A third aspect of the present invention provides a power tool, including:

a sun gear;

a planetary gear meshing with the sun gear;

an internal gear meshing with the planetary gear;

a spindle connected to the planetary gear;

an elastic member configured to urge the internal gear;

vibration cams configured to axially vibrate the spindle;

an internal gear lock pin configured to lock the internal gear in a nonrotatable manner; and a change ring connected to the elastic member, the vibration cams, and the internal gear lock pin.

The power tool according to the above aspects allows mode switching and clutch operation torque switching with the single ring.

DETAILED DESCRIPTION

Embodiments and modifications of the present invention will now be described below with reference to the drawings as appropriate.

The directional terms such as front, rear, up, down, right, and left in the embodiments and the modifications are defined for ease of explanation, and may be changed depending on, for example, at least the operating situations or the status of a movable member.

The present invention is not limited to the embodiments and modifications described below.

Figure 1:
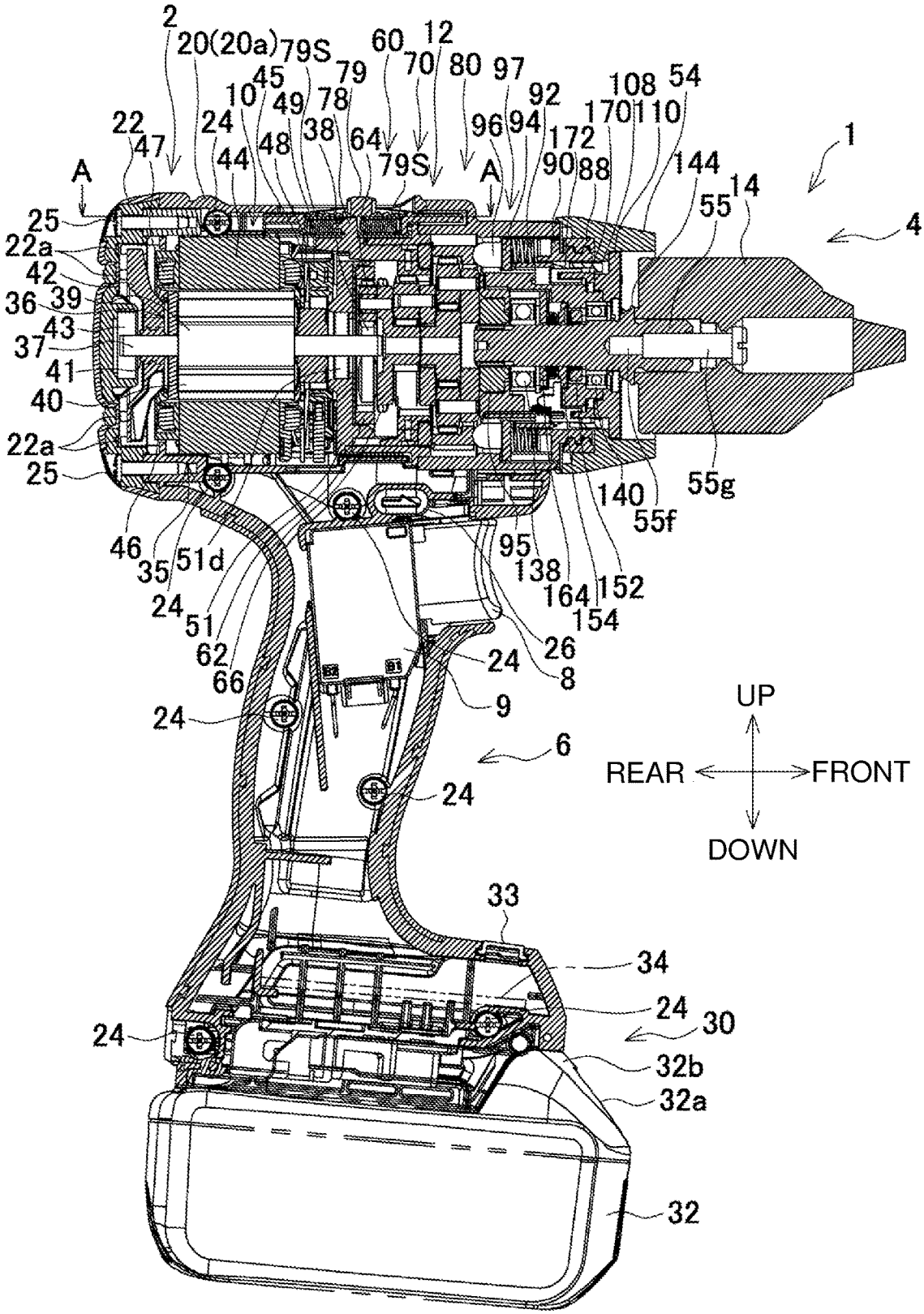
FIG. 1 is a longitudinal central sectional view of an electric vibration driver drill according to an embodiment of the present invention.
Figure 2:
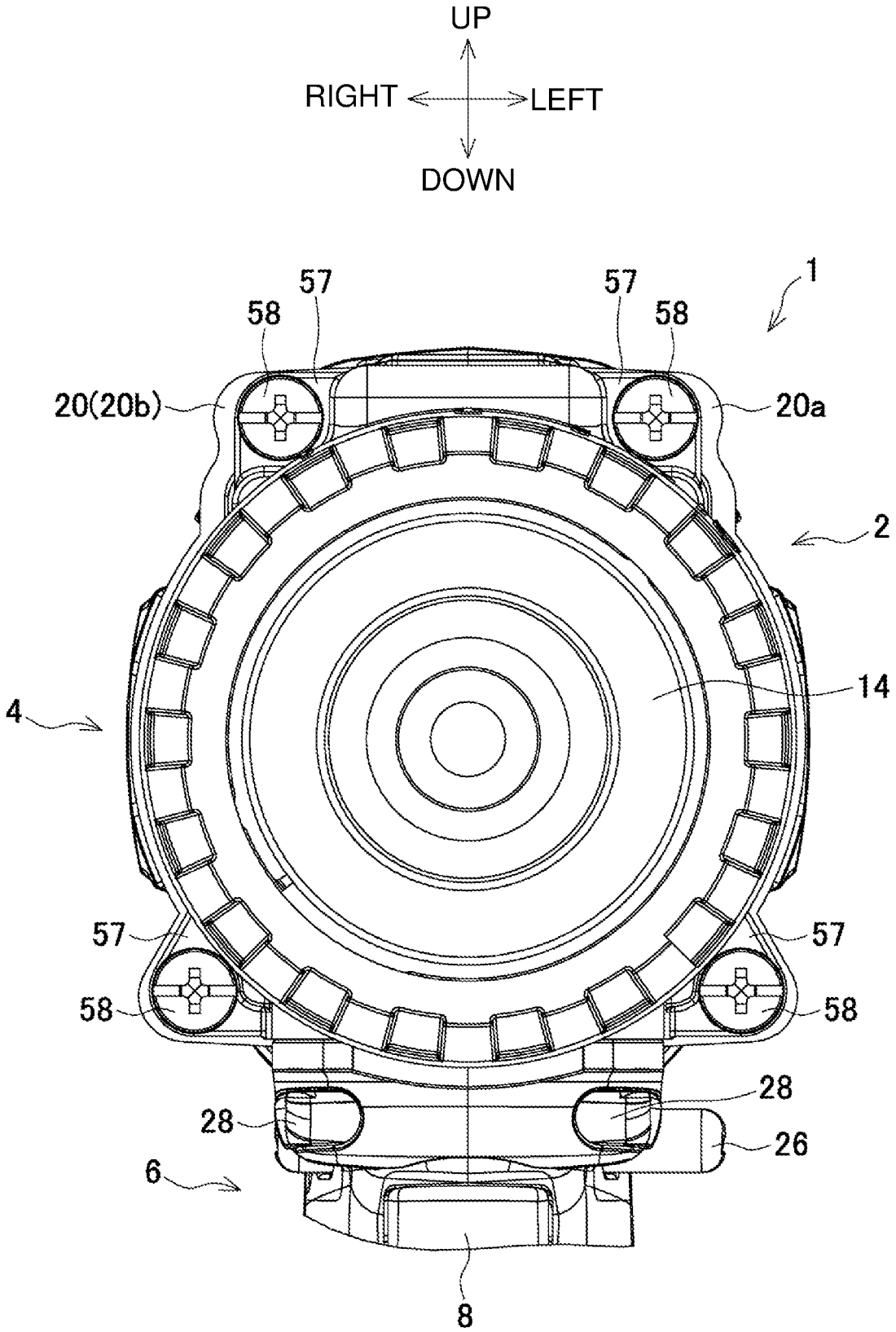
FIG. 2 is a front view of an upper portion in FIG. 1.
Figure 3:
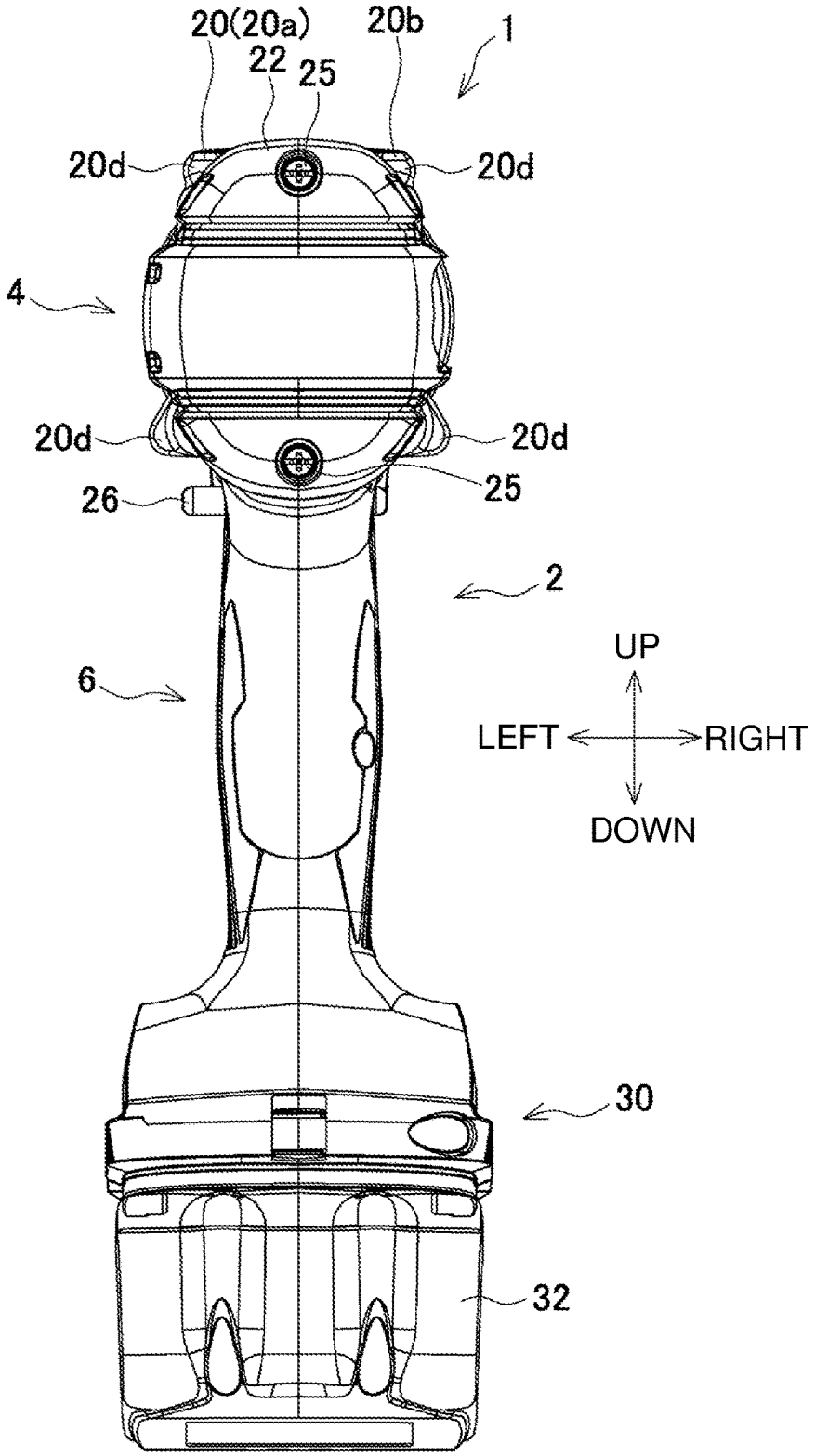
FIG. 3 is a rear view of the electric vibration driver drill in FIG. 1.
Figure 4:
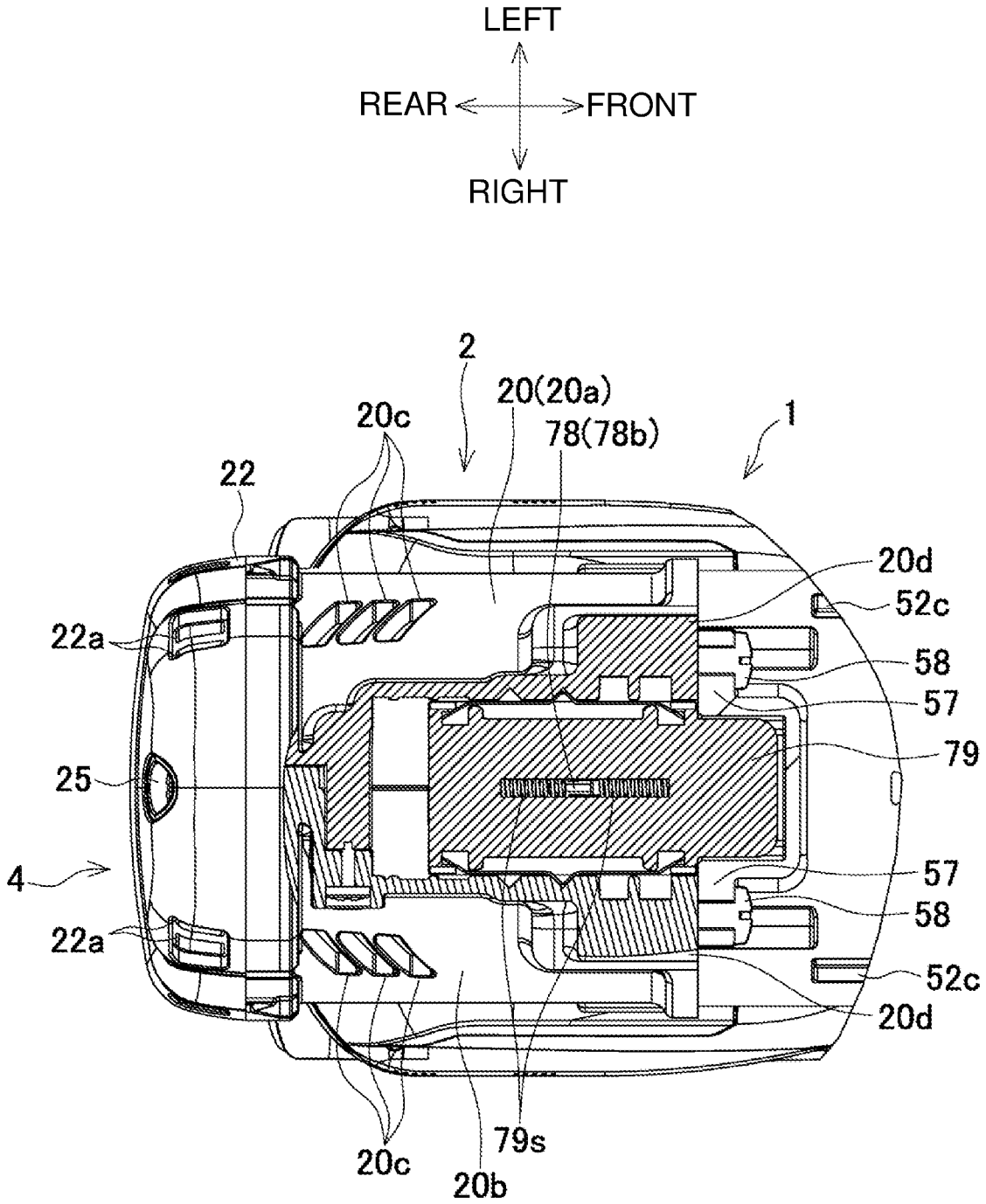
FIG. 4 is a cross-sectional view taken along line A-A in FIG. 1.
Figure 5:
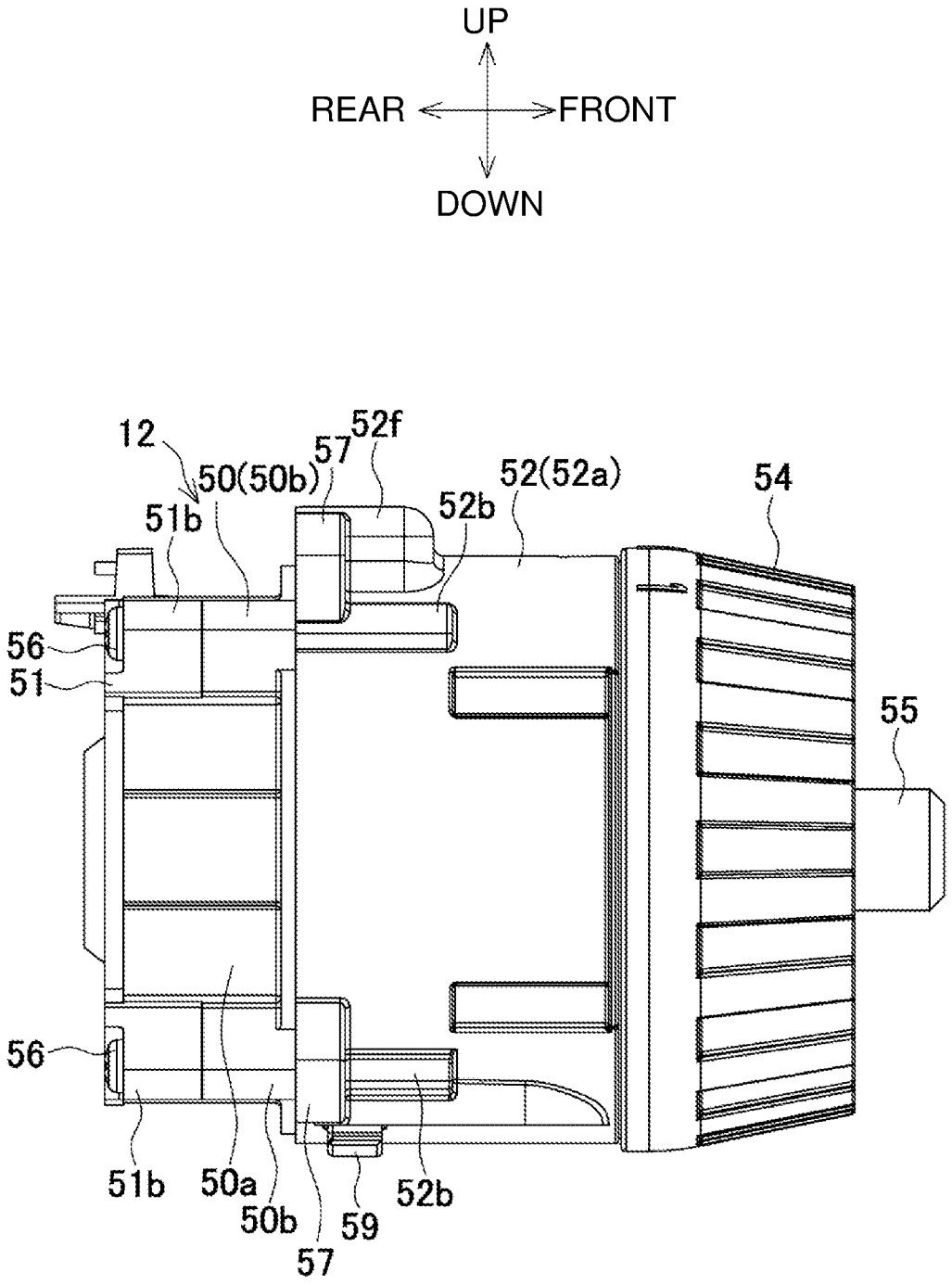
FIG. 5 is a right view of a gear assembly in the electric vibration driver drill shown in FIG. 1.

FIG. 1 is a longitudinal central sectional view of an electric vibration driver drill 1 as an example of a power tool. FIG. 2 is a front view of an upper portion of the electric vibration driver drill 1. FIG. 3 is a rear view of the electric vibration driver drill 1. FIG. 4 is a cross-sectional view taken along line A-A in FIG. 1.

The electric vibration driver drill (vibration driver drill, hammer driver drill, percussion driver) 1 includes a housing 2. The housing 2 defines an outer wall (frame) of the vibration driver drill 1.

The vibration driver drill 1 includes a body 4 and a grip 6. The body 4 is cylindrical, and has the central axis extending in the front-rear direction. The grip 6 protrudes downward from a lower portion of the body 4.

The grip 6 is gripped by a user. The grip 6 includes a trigger switch lever 8 at its upper end. The switch lever 8 is pulled with a fingertip of the user. The switch lever 8 protrudes from a switch body 9 (refer to FIG. 1).

As shown in FIG. 1, the body 4 accommodates a motor 10 in its rear portion. A gear assembly 12 is located in front of the motor 10. A chuck 14 for holding a bit (tip tool) is located in front of the gear assembly 12.

The motor 10 is a driving source of the vibration driver drill 1. The rotation of the motor 10 is reduced by the gear assembly 12, and the rotation is transmitted to the chuck 14 and to the bit.

The housing 2 includes a body housing 20 and a rear cover 22. The body housing 20 is formed from a resin, and holds the motor 10, the switch body 9, and other components. The rear cover 22 is formed from a resin, and covers the rear portion of the motor 10.

The body housing 20 includes an outer wall of the grip 6.

The body housing 20 includes a halved left body housing 20*a* and a halved right body housing 20*b*. The left body housing 20*a* has multiple screw bosses. The right body housing 20*b* has screw holes corresponding to the screw bosses. The left body housing 20*a* and the right body housing 20*b* are joined with multiple screws 24 extending in the lateral direction in the screw bosses and the screw holes, and inserted from the right.

The rear portions of the left body housing 20*a* and the right body housing 20*b* fit together to define an opening. The rear cover 22 is fixed to the left body housing 20*a* and/or the right body housing 20*b* with multiple screws 25 extending in the front-rear direction to cover the opening. The screws 25 are each located on the upper or lower end of the rear cover 22 to fasten the rear cover 22 reliably.

The left body housing 20*a* and the right body housing 20*b* have multiple air inlets 20*c* on the upper and lower side surfaces in the rear end portions. Each air inlet 20*c* extends vertically. The air inlets 20*c* are located in the front-rear direction (refer to FIG. 4). The air inlets 20*c* are thus sequential slits arranged along an area in front of and adjacent to the rear cover 22. Multiple air outlets 22*a* are located behind the air inlets 20*c* on the side surfaces of the rear cover 22. Each air outlet 22*a* extends in the front-rear direction. The air outlets 22*a* are located vertically (refer to FIGS. 1 and 4).

A forward-reverse switch lever 26 is located behind the switch lever 8. The forward-reverse switch lever 26 is used to switch the rotation direction of the motor 10. The forward-reverse switch lever 26 is placed through a boundary area between the body 4 and the grip 6 in the lateral direction.

Above the switch lever 8, multiple (two) light sources 28 are located in front of the forward-reverse switch lever 26. The light sources 28 can illuminate the front. The light sources 28 are located in the lateral direction. The light sources 28 are, for example, light-emitting diodes (LEDs).

The grip 6 includes a battery mount 30 at its lower end. The battery mount 30 is flared outward with respect to the upper portion. A battery 32 is held below the battery mount 30. The battery 32 is detachable using a battery button 32*a*. The battery 32, which is for example a lithium-ion battery, contains multiple cells (not shown). The cells are axially elongated columns facing in the lateral direction.

The battery mount 30 includes a display 33 in its front upper portion (the front upper surface of the flared lower portion of the grip 6). The display 33 displays the status of electronic gears by illuminating multiple lamps.

The battery 32 is attached by sliding the battery 32 from the front to the rear of the battery mount 30 with a battery terminal facing upward and a raised portion 32*b* facing upward and frontward. When the battery 32 is attached, the rear of the raised portion 32*b* comes in contact with the front of the battery mount 30, and the battery terminal comes in contact with a battery mount terminal in the battery mount 30. During the attachment, a battery tab urged upward by an elastic member and protruding from the upper surface near the front portion of the battery 32 is fitted into a battery mount recess that is an upward recess in the lower front of the battery mount 30. In contrast, the battery 32 is removed by operating the battery button 32*a* connected to the battery tab. This allows forward sliding of the battery 32 with the battery tab disengaged from the battery mount recess.

As shown in FIG. 1, the battery mount 30 holds a control circuit board 34 included in a controller for controlling a motor. The control circuit board 34 includes a columnar capacitor (not shown) protruding upward from other components and a microcomputer (not shown). The control circuit board 34 is electrically connected to the motor 10 with a power lead wire and a signal lead wire (not shown). The control circuit board 34 is electrically connected to the battery mount terminal in the battery mount 30 and the switch body 9. The control circuit board 34 is electrically connected to the display 33, and controls, for example, information appearing on the display 33.

As shown in FIG. 1, the motor 10 is a brushless motor, and includes a cylindrical stator 35 and a rotor 36. The rotor 36 is located inward from the stator 35.

The rotor 36 includes a motor shaft 37, a pinion 38, a rotor core 39, and a permanent magnet 40. The motor shaft 37 is columnar, and extends in the front-rear direction. The pinion 38 is integral with the front end of the motor shaft 37. The rotor core 39 is cylindrical, and surrounds the middle portion of the motor shaft 37. The permanent magnet 40 is placed inside the rotor core 39.

A cooling fan 42 is attached behind the motor shaft 37 via a metal insert bush 41. The fan 42 is a centrifugal fan. The insert bush 41 is press-fitted onto the motor shaft 37 and fastened firmly. Thus, the fan 42 fastened to the insert bush 41 is less likely to rotate relative to the motor shaft 37.

The air outlets 22*a* are located radially outward from the fan 42.

A motor rear bearing 43 is held behind the fan 42 and on the inner surface of the rear of the rear cover 22. The motor rear bearing 43 supports the rear end of the motor shaft 37 in a rotatable manner.

The stator 35 includes a stator core 44, a front insulator 45, a rear insulator 46, a coil 47, a sensor board 48, and a metal plate 49. The stator core 44 includes multiple teeth and a cylindrical portion having an axis extending in the front-rear direction. The teeth protrude radially inward from the inner surface of the cylindrical portion. The front insulator 45 and the rear insulator 46 are ring-shaped. The front insulator 45 is attached to the front end of the stator core 44, and the rear insulator 46 is attached to the rear end of the stator core 44. The coil 47 is wound around the teeth via the front insulator 45 and the rear insulator 46. The sensor board 48 is attached in front of the front insulator 45. The metal plate 49 is formed from a synthetic resin. The metal plate 49 is annular and includes multiple arc-shaped metal sheets. The metal plate 49 is attached in front of the sensor board 48.

The sensor board 48 detects the rotational position of the rotor 36 (permanent magnet 40) and transmits the information to the control circuit board 34.

The metal sheets of the metal plate 49 electrically connect the coils 47 to each other in a predetermined manner. The metal sheets of the metal plate 49 are connected to the power lead wire connected to the control circuit board 34.

As shown in FIGS. 5 to 15, the gear assembly 12 includes a gear case 50, a motor bracket 51, a gear housing 52, and a change ring 54. The gear case 50 is cylindrical, and defines an outer wall of the gear assembly 12. The motor bracket 51 is plate-like (dish-shaped), and is located behind the rear end of the gear case 50. The gear housing 52 is formed from a metal. The gear housing 52 is a double cylinder including inner and outer portions. The gear housing 52 is located in front of the gear case 50. The change ring 54 is located in front of the gear housing 52, and is exposed on the upper front of the housing 2. The change ring 54 is used for mode switching, and is externally mounted on the housing 2.

A spindle 55 is located radially inside a front portion of an outer wall of the gear assembly 12. The spindle 55 extends along the central axis of the gear assembly 12. The spindle 55 has a front end protruding frontward from an outer wall of the gear assembly 12.

The spindle 55 is a column having an axis extending in the front-rear direction. The spindle 55 includes a spindle flange 55*a*, a front step 55*b*, a middle step 55*c*, a rear step 55*d*, a clip groove 55*e*, and a spindle hole 55*f*. The spindle flange 55*a* widens radially outward from its middle portion in the front-rear direction. The front step 55*b*, the middle step 55*c*, and the rear step 55*d* are located behind the spindle flange 55*a* and each have a smaller diameter than the step located forward. The clip groove 55*e* extends circumferentially in the front of the middle step 55*c*. The spindle hole 55*f* extends in the front-rear direction in a front central portion of the spindle 55, and has a front end opening. The spindle hole 55*f* is a bolt hole having a threaded groove. An external thread (not shown) are formed on the outer surface of the spindle 55 radially outward of the spindle hole 55*f*.

The chuck 14 has an internal thread (not shown) corresponding to the external thread on the spindle 55. The internal thread on the chuck 14 receives the external thread on the spindle 55, and the spindle hole 55*f* receives a bolt 55*g*. This fastens the chuck 14 to the spindle 55. At least one of the spindle 55 and the chuck 14 serves as an output shaft.

The gear case 50 includes a cylindrical gear case base 50*a*. The gear case base 50*a* has screw hole portions 50*b* at its upper right, lower right, upper left, and lower left ends. The screw hole portions 50*b* each have a screw hole at the center of a tab piece protruding radially outward. The motor bracket 51 includes a motor bracket base 51*a*, which is a cylinder with a bottom. The motor bracket base 51*a* includes screw hole portions 51*b*. Screw holes 52*b* are formed at the rear of an outer cylinder 52*a* of the gear housing 52. The screw hole portions 51*b* protrude radially outward and further frontward. The screw holes 52*b* protrude radially outward. A screw 56 extends through the upper right screw hole portions 50*b* and 51*b* and the screw hole 52*b*. Screws 56 also extend through the lower right, upper left, and lower left screw hole portions 50*b* and 51*b* and screw holes 52*b* as well. In this manner, the gear case 50 and the gear housing 52 (and the motor bracket 51) are fastened together with a common connector (screws). This improves the degree of contact between components and protects the inner mechanism, and may prevent leakage of grease used in the inner mechanism. The gear assembly 12 is more compact than when connectors are provided separately for connecting the motor bracket 51 and the gear case 50 and for connecting the gear case 50 and the gear housing 52.

A side handle (not shown) is attachable to the outer cylinder 52*a* in the gear housing 52.

The gear assembly 12 is attached in front of the opening in the body housing 20 with screws 58. The screws 58 are placed through screw hole portions 57 located radially outward from the screw holes 52*b* in the gear housing 52, and are screwed into screw hole portions 20*d* having screw holes in the opening in the body 4. The lateral distance between the two upper screw hole portions 57 is smaller than between the two lower screw hole portions 57. The screw hole portions 57 are located in correspondence with the shape of the columnar body 4, under which the grip 6 extends. The upper portion of the body 4 is thus laterally compact.

The outer cylinder 52*a* in the gear housing 52 has tab members 59 on its right rear and left rear on the lower surface. The tab members 59 protrude downward and laterally outward. Each tab member 59 is engaged with the inner surface of the body housing 20 to prevent the gear assembly 12 and the body housing 20 from being separated.

The gear housing 52 has front, side, and upper portions exposed to define a portion of an outer wall of the body 4. The gear housing 52 is a part of the housing 2.

The motor bracket 51 has a center hole 51*c* for receiving a motor front bearing 51*d*. The motor front bearing 51*d* supports a front end of the motor shaft 37 (a rear side of the pinion 38) in a rotatable manner.

At least one of the motor bracket 51, the change ring 54, and the spindle 55 may not be a component of the gear assembly 12. The motor bracket 51 may be a component of the motor 10. Also, at least one of the chuck 14, the motor front bearing 51*d*, and the pinion 38 may be a component of the gear assembly 12.

The gear assembly 12 contains a planetary gear mechanism with three stages. The gear assembly 12 reduces the rotation of the motor shaft 37 and transmits the rotation to the spindle 55. The gear assembly 12 includes a rear planetary gear mechanism 60 (first reduction mechanism), a middle planetary gear mechanism 70 (second reduction mechanism), and a front planetary gear mechanism 80 (third reduction mechanism).

The rear planetary gear mechanism 60 includes an internal gear 62, multiple (five) planetary gears 64, and a carrier 66. The internal gear 62 is fixed inside the gear case 50. The planetary gears 64 include external teeth meshing with internal teeth on the internal gear 62. The carrier 66 supports the planetary gears 64 via needle bearings 65 in a rotatable manner.

The internal gear 62 is locked in a nonrotatable manner, with multiple (four) projections 62*b* fitted into multiple slits 51*e*. The projections 62*b* protrude radially outward from a ring-shaped internal teeth portion 62*a*. The slits 51*e* are formed on the cylindrical surface of the motor bracket base 51*a* and extend in the front-rear direction.

The planetary gears 64 mesh with the pinion 38 on the motor shaft 37.

The carrier 66 includes five pins 66*b*. The five pins 66*b* protrude rearward at circumferentially equal intervals from the rear surface of a disk member 66*a* having a center hole. Each pin 66*b* supports a single planetary gear 64 and a single needle bearing 65. The carrier 66 includes an external gear 66*c*. The external gear 66*c* cylindrically protrudes frontward from the front center of the disk member 66*a*. The disk member 66*a* includes meshing teeth 66*d* on its outer front surface.

The planetary gears 64 are supported by the needle bearing 65, and thus are supported more firmly than a ball bearing. The planetary gears 64 with smaller thicknesses in the axial direction (front-rear direction) achieve substantially the same strength as a ball bearing, thus downsizing not only the planetary gears 64 and the rear planetary gear mechanism 60, but also the vibration driver drill 1 in the front-rear direction.

A washer 68 is located between the planetary gears 64 and the motor bracket 51.

Figure 13:
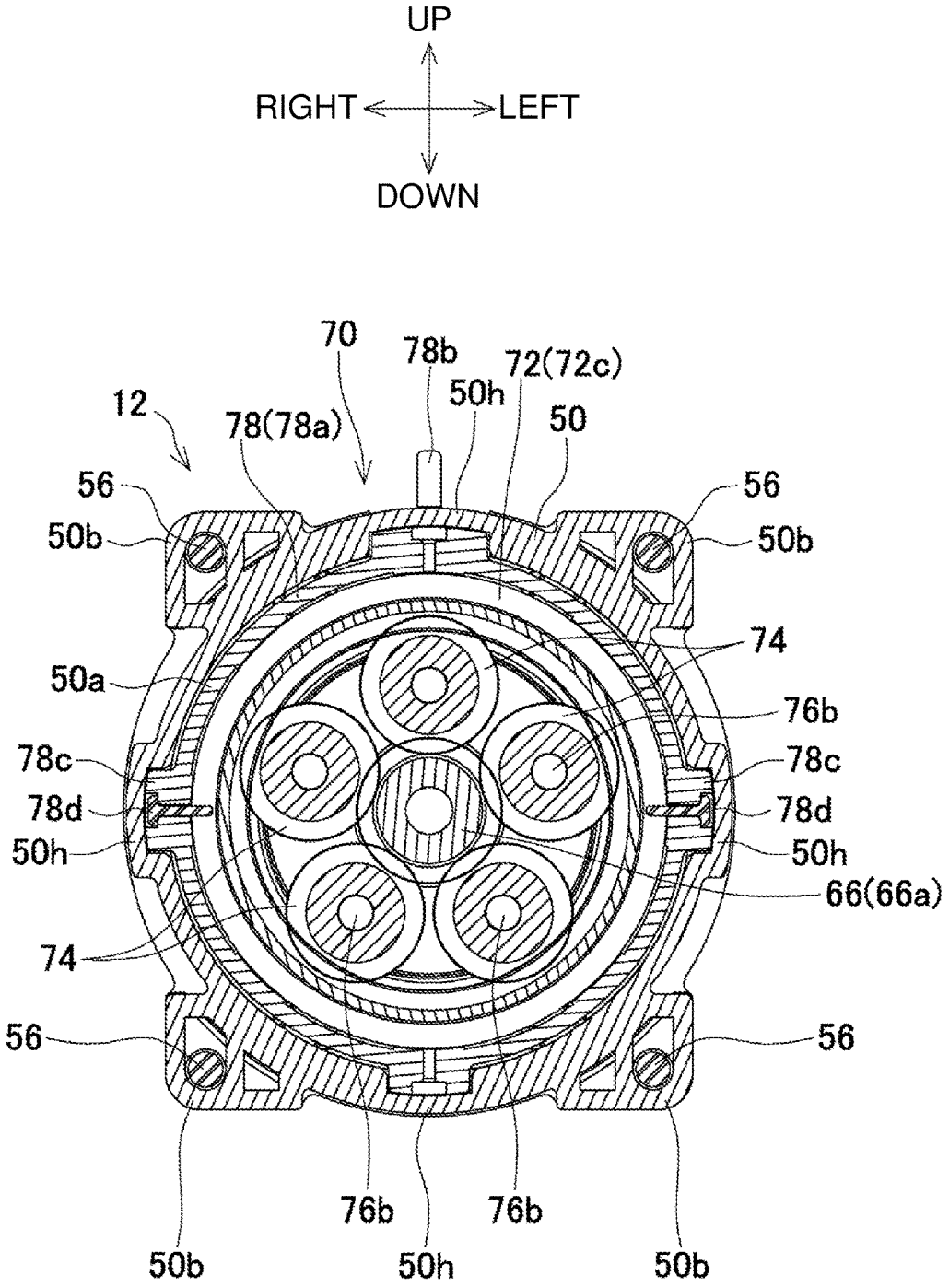
FIG. 13 is a cross-sectional view taken along line F-F in FIG. 8.
Figure 14:
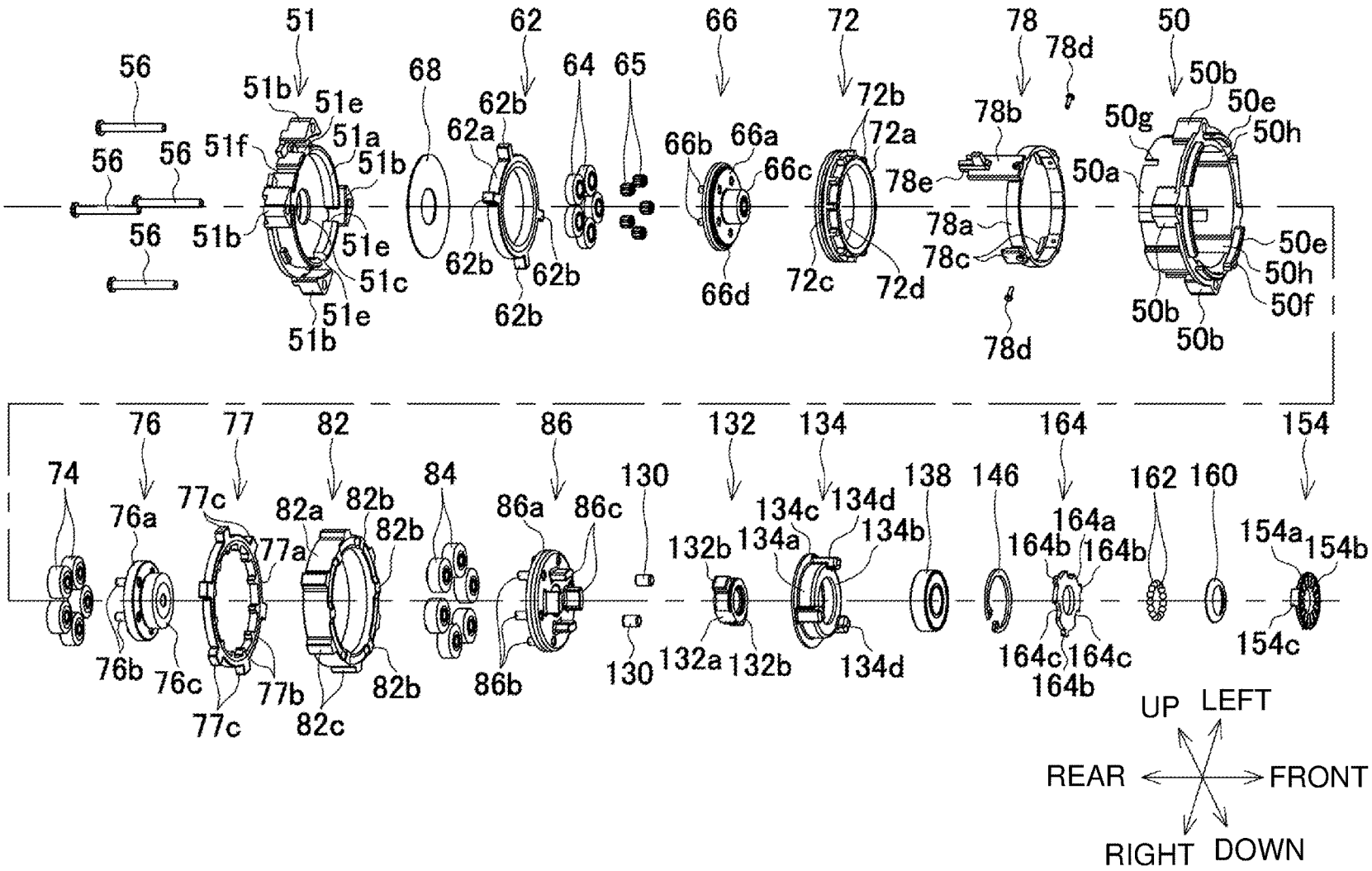
FIG. 14 is an exploded perspective view of a rear portion of the gear assembly shown in FIG. 5.
Figure 15:
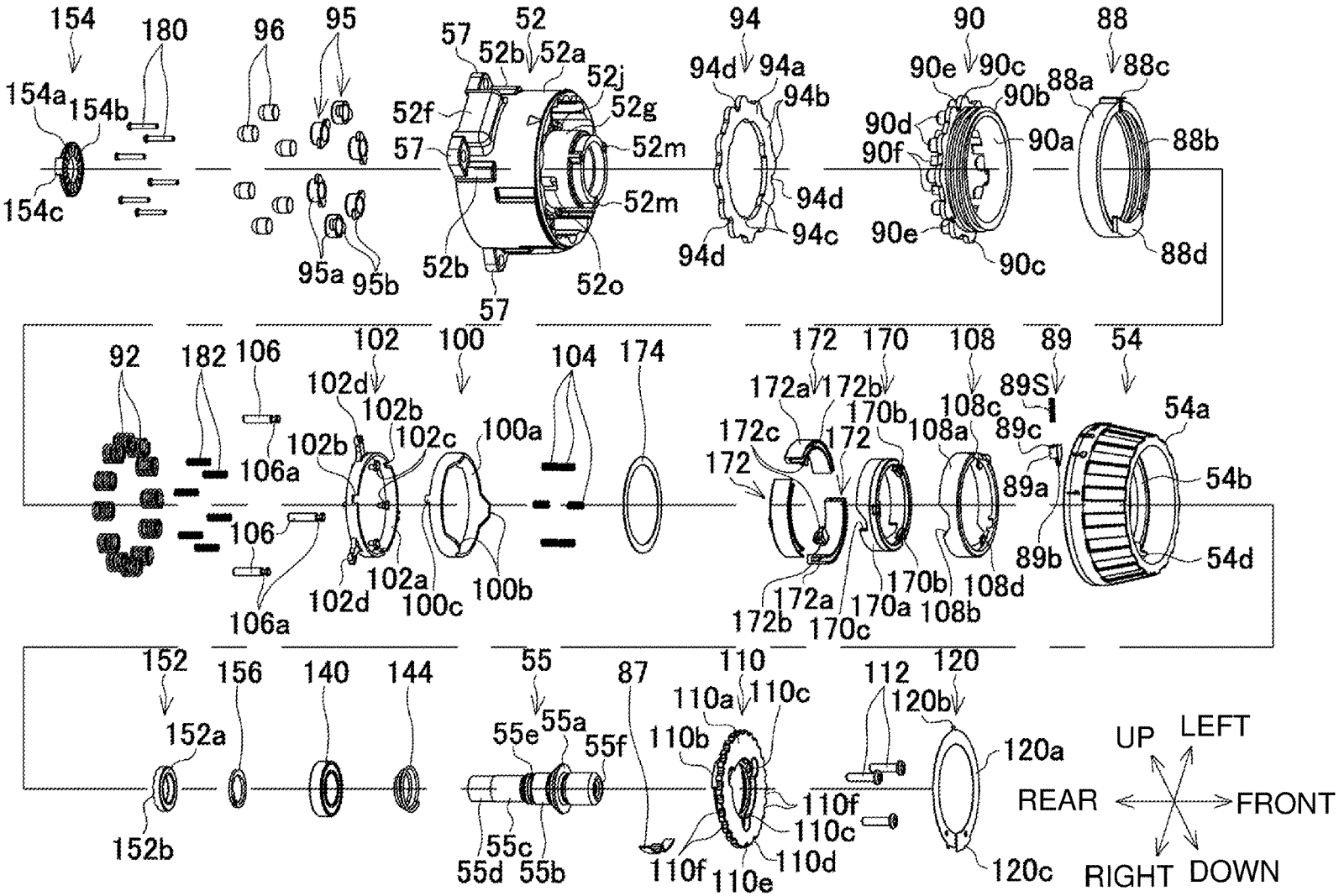
FIG. 15 is an exploded perspective view of a front portion of the gear assembly shown in FIG. 5.

As also shown in FIG. 13, the middle planetary gear mechanism 70 includes an internal gear 72, multiple (five) planetary gears 74, and a carrier 76. The planetary gears 74 include external teeth meshing with internal teeth on the internal gear 72. The carrier 76 supports the planetary gears 74 in a rotatable manner.

A ring-shaped internal teeth portion 72*a* of the internal gear 72 has, on its outer front surface, multiple external teeth 72*b* arranged at circumferentially predetermined intervals. The external teeth 72*b* protrude in the radial direction and extend in the front-rear direction. The internal teeth portion 72*a* has, on its outer rear surface, a connection groove 72*c* extending circumferentially. The internal gear 72 includes meshing teeth 72*d* near its opening on the rear surface. The meshing teeth 72*d* are meshable with the meshing teeth 66*d* on the first carrier 66.

The planetary gears 74 mesh with the external gear 66*c* of the first carrier 66.

The carrier 76 includes five pins 76*b*. The pins 76*b* protrude rearward from the rear surface of a disk member 76*a* having a center hole. Each pin 76*b* supports a single planetary gear 74. The carrier 76 includes an external gear 76*c* (sun gear). The external gear 76*c* cylindrically protrudes frontward from the front center of the disk member 76*a*.

A connection ring 77 is located outside and in front of the internal gear 72. The connection ring 77 is held in the rear portion of the gear housing 52. An annular connection ring base 77*a* of the connection ring 77 includes as many internal teeth 77*b* as the external teeth 72*b* on its inner circumferential surface. The internal teeth 77*b* protrude radially inward and extend in the front-rear direction. The connection ring base 77*a* includes multiple (six) ridges 77*c* at circumferentially predetermined intervals on its outer circumferential surface. The ridges 77*c* protrude outward and extend in the front-rear direction. Each external tooth 72*b* enters between two of the internal teeth 77*b*.

The gear case base 50*a* has, on its front end, multiple arc ribs 50*e* at circumferentially equal intervals. The outer cylinder 52*a* in the gear housing 52 has, on its inner rear surface at the rear end, inner grooves (not shown) extending in the front-rear direction and receding radially outward. The connection ring 77 is locked in a nonrotatable manner, with the ridges 77*c* each received in a space between the corresponding arc ribs 50*e* and received in the corresponding inner groove on the outer cylinder 52*a* in the gear housing 52. The space between the arc ribs 50*e* is continuous with the inner groove on the outer cylinder 52*a* in the front-rear direction. The lower arc rib 50*e* has, on its radially outer surface, a protrusion 50*f* protruding radially outward. The protrusion 50*f* is received in a lower inner groove (not shown) extending in the front-rear direction and receding radially outward on the inner rear surface of the outer cylinder 52*a* in the gear housing 52.

As shown in FIG. 13, a speed switch ring 78 is located outside and behind the internal gear 72. The speed switch ring 78 includes an annular speed switch ring base 78*a*. The speed switch ring base 78*a* has, in its upper portion, an L-shaped connector 78*b* protruding rearward and upward. The speed switch ring base 78*a* has protruding pieces 78*c* protruding radially outward and rearward from its left, right, and bottom portions.

The gear case 50 has a slit 50*g* extending frontward from its upper rear. The slit 50*g* receives a lower end of the upper protrusion on the connector 78*b*. The upper portion of the upper protrusion on the connector 78*b* is connected to the lower portion of a speed switch lever 79 (refer to FIGS. 1 and 4) with coil springs 79S. The speed switch lever 79 is slidable forward and rearward in an upper portion of the housing 2. The coil springs 79S are elastic members aligned with each other in the front-rear direction. A front portion of the speed switch lever 79 is received in a hole 52*f* extending frontward from an upper rear end of the outer cylinder 52*a*. The screw hole portions 57 are located on the right and left of the hole 52*f*.

As shown in FIG. 13, the gear case base 50*a* has, on its inner surface, guide grooves 50*h* extending in the front-rear direction. Each guide groove 50*h* receives the corresponding protruding piece 78*c*. The guide grooves 50*h* receiving the corresponding protruding pieces 78*c* support the speed switch ring 78 in a movable manner in the front-rear direction alone.

Two pins 78*d* extend radially inward from outside in the left and right protruding pieces 78*c*. The outer head of each pin 78*d* comes in contact with the outer surface of the left or right protruding piece 78*c*. The inner tip of each pin 78*d* smaller than the head protrudes radially inward from the inner surface of each protruding piece 78*c* and is received in the connection groove 72*c*.

The speed switch lever 79 is moved forward (as shown in FIG. 1) to move the speed switch ring 78 forward with the connector 78*b*. The internal gear 72 then moves forward with the pins 78*d* and the connection groove 72*c*, while remaining meshed with the planetary gears 74. Each external tooth 72*b* thus enters between the internal teeth 77*b* on the connection ring 77 to regulate the rotation of the internal gear 72 in the circumferential direction. The planetary gears 74 revolve about the locked internal gear 72, transmitting rotation slower than the rotation of the first external gear 66*c* to the external gear 76*c* of the carrier 76. More specifically, the speed switch lever 79 is operated forward to enable a low speed mode in which the second middle planetary gear mechanism 70 performs speed reduction.

The speed switch lever 79 is operated rearward to move the speed switch ring 78 rearward. The internal gear 72 thus moves rearward, while remaining meshed with the planetary gears 74. Each external tooth 72*b* exits from between the internal teeth 77*b* on the connection ring 77 to deregulate the rotation of the internal gear 72 in the circumferential direction. The meshing teeth 66*d* on the first carrier 66 mesh with the meshing teeth 72*d* on the internal gear 72. The internal gear 72 unlocked in the circumferential direction and the first carrier 66 rotate together to transmit the same rotation as the external gear 66*c* to the external gear 76*c*. More specifically, the speed switch lever 79 is operated rearward to enable a high speed mode in which the second middle planetary gear mechanism 70 does not perform speed reduction.

A rib 78*e* is located at the lateral center on a bottom surface of the connector 78*b*. The rib 78*e* extends in the front-rear direction, and protrudes downward. This structure increases the rigidity of the connector 78*b* to prevent flexure, thus allowing the internal gear 72 to be positionally stable after operated with the speed switch ring 78. The rib 78*e* is received in a groove 51*f* on an upper surface of the motor bracket base 51*a*. The groove 51*f* extends in the front-rear direction and recedes downward. The slit 50*g* on the gear case 50 is located above the groove 51*f*.

The front planetary gear mechanism 80 includes an internal gear 82, multiple (six) planetary gears 84, and a carrier 86. The internal gear 82 is rotatable in the circumferential direction inside the gear housing 52. The planetary gears 84 include external teeth meshing with internal teeth on the internal gear 82. The carrier 86 supports the planetary gears 84 in a rotatable manner.

The internal gear 82 has, on its front surface, a cylindrical internal teeth portion 82*a* having multiple (six) cam projections 82*b* arranged at circumferentially predetermined intervals. The cam projections 82*b* protrude frontward. The internal teeth portion 82*a* has, on its outer surface, multiple (six) protrusions 82*c*. The protrusions 82*c* protrude radially outward. Each protrusion 82*c* is located circumferentially in the middle between the cam projections 82*b* on the internal teeth portion 82*a*.

The planetary gears 84 mesh with the external gear 76*c* of the second carrier 76.

Figure 12:
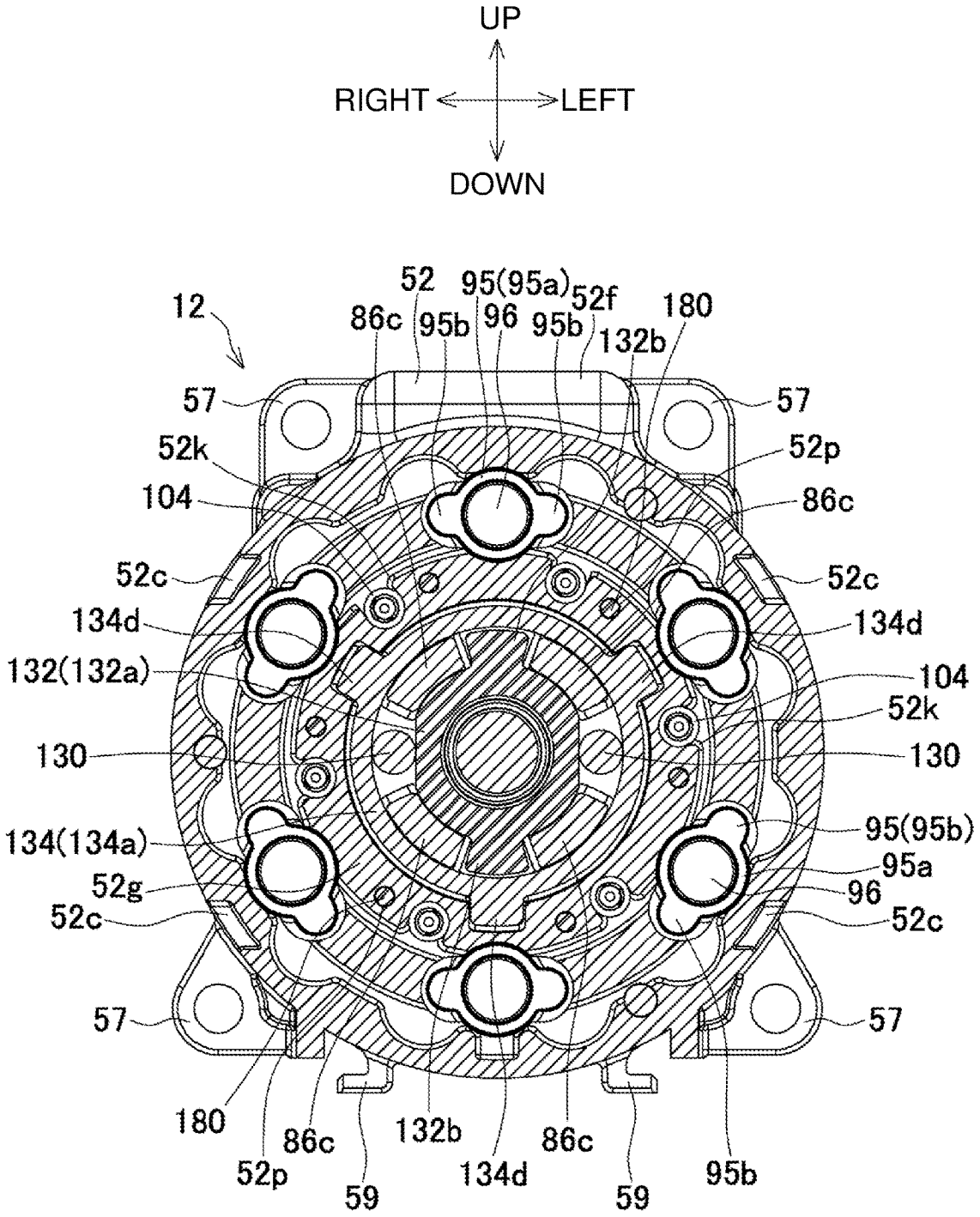
FIG. 12 is a cross-sectional view taken along line E-E in FIG. 8.

The carrier 86 includes multiple (six) pins 86*b*. The pins 86*b* protrude rearward from the rear surface of a disk member 86*a* having a center hole. Each pin 86*b* supports a single planetary gear 84. As shown in FIG. 12, the carrier 86 includes multiple (four) tab members 86*c*. The tab members 86*c* each are a quarter cylinder protruding frontward from the middle of the front surface of the disk member 86*a*. The multiple (four) tab members 86*c* are aligned circumferentially.

The change ring 54 is located radially outward from an inner cylinder 52*g* in the gear housing 52. The inner cylinder 52*g* has a smaller diameter than the outer cylinder 52*a*. The front end of the inner cylinder 52*g* is located more frontward than the front end of the outer cylinder 52*a*.

The change ring 54 includes a change ring base 54*a* and a rib 54*b*. The change ring base 54*a* is a cylinder tapered frontward, and includes recesses and protrusions on an outer surface. The rib 54*b* protrudes radially inward from the inner surface of the change ring base 54*a* in the middle in the front-rear direction.

The change ring base 54*a* has a hole 54*c* (upper left in FIG. 10A) in the inner surface at the same position as the rib 54*b* in the front-rear direction. The hole 54*c* recedes radially more outward than the inner surface of the change ring base 54*a*. A recess 54*d* (lower right in FIG. 10A) faces the hole 54*c*. The recess 54*d* recedes radially more outward than other part of the inner surface of the change ring base 54*a*, and circumferentially extends in an arc. Engagement parts 54*e* are located on both circumferential ends of the recess 54*d*. The engagement parts 54*e* engage with a leaf spring 87. The leaf spring 87 has a middle portion swelling radially inward, and is urged radially inward.

A clutch switch ring 88 is located behind the rib 54*b* radially inside the change ring 54.

The clutch switch ring 88 includes a clutch switch ring base 88*a*, a thread 88*b*, a lock lever holder 88*c*, and a protruding piece 88*d*. The clutch switch ring base 88*a* is in ring shape. The thread 88*b* is helically formed on the inner surface of the clutch switch ring base 88*a*. The lock lever holder 88*c* extends radially outward from a portion of the clutch switch ring base 88*a*, and protrudes frontward while being bifurcated. The protruding piece 88*d* opposite to the lock lever holder 88*c* extends frontward and radially inward from a portion of the clutch switch ring base 88*a*.

The protruding piece 88*d* has the same shape as the recess 54*d* on the change ring 54 as viewed from the front. The recess 54*d* receives the protruding piece 88*d* to rotate the change ring 54 and the clutch switch ring 88 together. The lock lever holder 88*c* is received in a radially inward part of the hole 54*c*.

A lock lever 89 extends radially between the change ring 54 and the clutch switch ring 88.

The lock lever 89 as a locking member includes a lock lever base 89*a*, a follower 89*b*, and lock lever ribs 89*c*. The lock lever base 89*a* is a prism having open sides radially outward and rearward. The follower 89*b* is a triangular plate extending radially inward from a radially inner front end of the lock lever base 89*a*. The lock lever ribs 89*c* protrude outward in the circumferential direction from radially outer ends of the lock lever base 89*a*.

The lock lever base 89*a* is held by the lock lever holder 88*c* (between the bifurcated protrusions) of the clutch switch ring 88. The lock lever base 89*a* is received in the hole 54*c*. This causes the clutch switch ring 88 to rotate together with the lock lever 89.

Figure 10A:
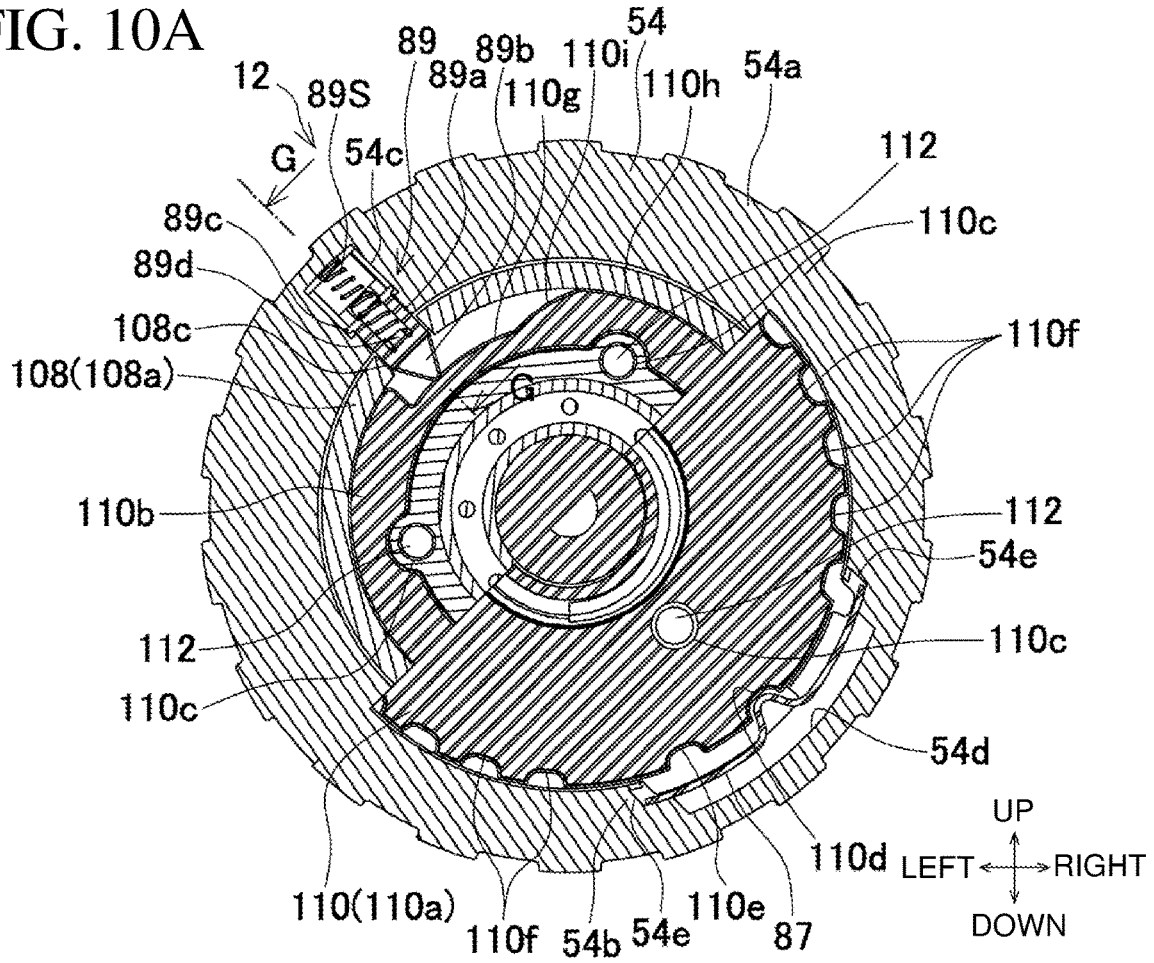
FIG. 10A is a cross-sectional view taken along line C-C in FIG. 8.
Figure 10B:
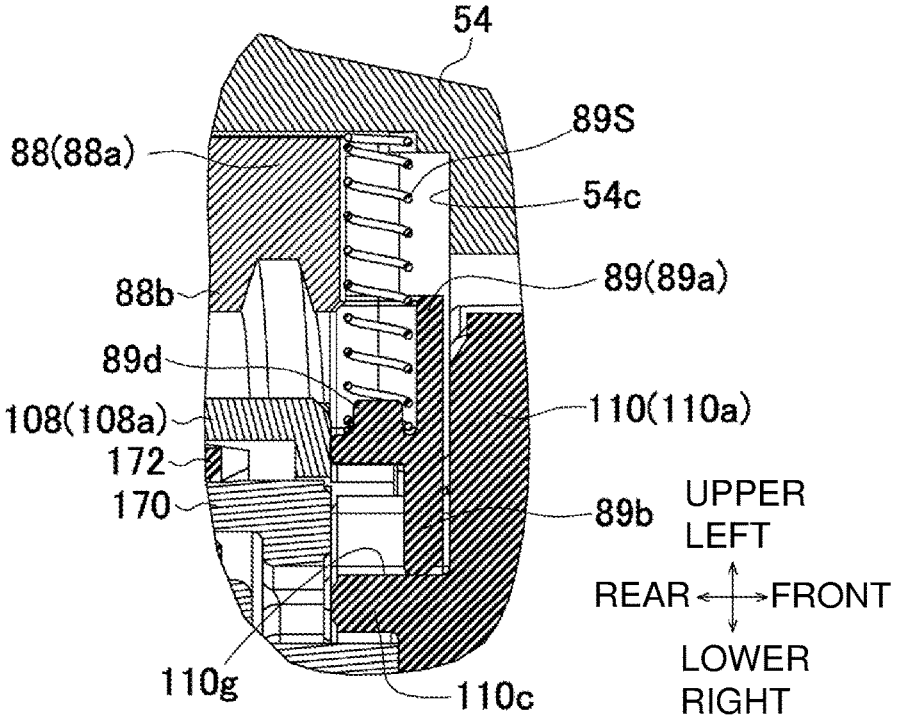
FIG. 10B is a cross-sectional view taken along line G-G in FIG. 10A.

The lock lever base 89*a* internally includes a spring 89S as an elastic member. The spring 89S extends radially. A radially outer end of the spring 89S comes in contact with the radially outer bottom of the hole 54*c* (inner surface of the change ring 54). A radially inner end of the spring 89S comes in contact with a radially inner surface of the lock lever base 89*a*, and urges the lock lever 89 radially inward. As shown in FIG. 10B, the lock lever base 89*a* includes a spring holding projection 89*d* on its radially inner surface. The spring holding projection 89*d* protrudes upward from other portion, and is received in an inner diameter portion of the spring 89S to hold the spring 89S.

The lock lever ribs 89*c* are not in contact with the hole 54*c*. In placing the lock lever 89 and the spring 89S, the lock lever ribs 89*c* can be placed in the hole 54*c* when aligned correctly. This prevents the lock lever 89 from being oriented incorrectly. Also, the lock lever ribs 89*c* are temporarily caught by the hole 54*c*, and thus prevent the lock lever 89 and the spring 89S from slipping out of the hole 54*c*.

Figure 8:
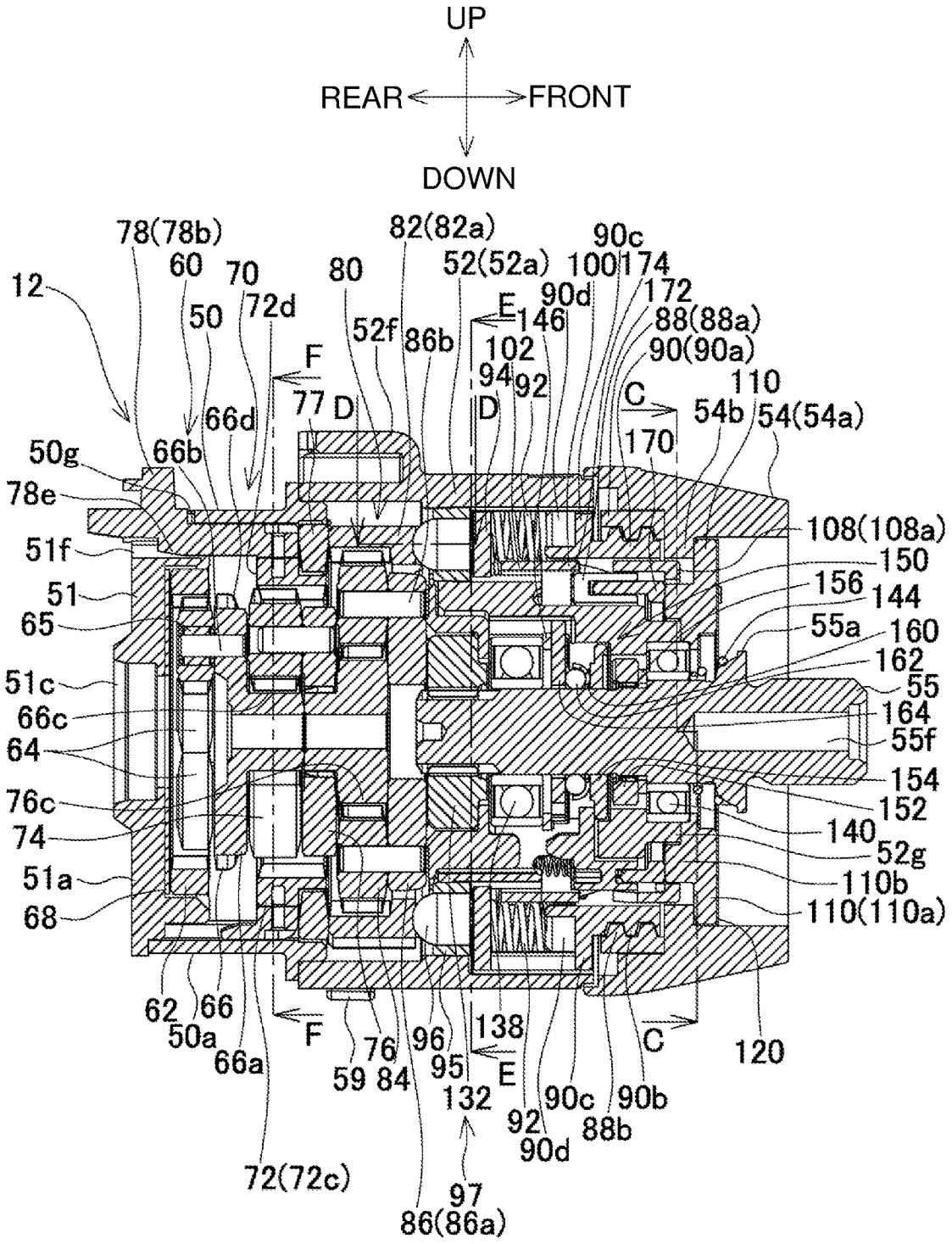
FIG. 8 is a longitudinal central sectional view of the gear assembly in FIG. 5.
Figure 9:
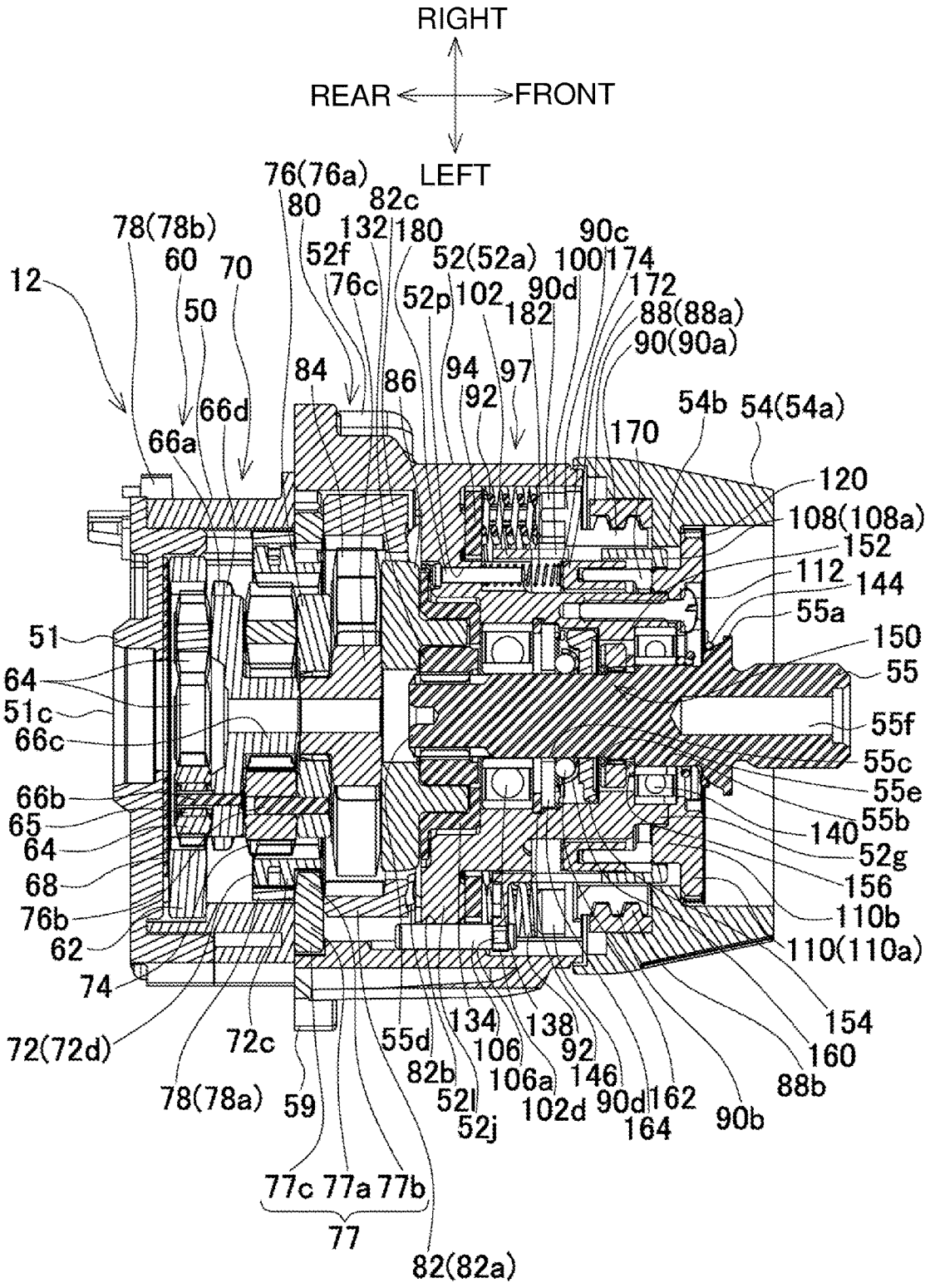
FIG. 9 is a cross-sectional view taken along line B-B in FIG. 6.

As shown in FIGS. 8 and 9, an annular spring holder 90 as an elastic holder is located radially inward from the clutch switch ring 88.

The spring holder 90 includes a cylindrical spring holder base 90*a* having a thread 90*b* on its outer surface. The thread 90*b* includes a thread to mesh with the thread 88*b* on the clutch switch ring 88. The clutch switch ring 88 rotates to move the spring holder 90 in the front-rear direction.

The spring holder base 90*a* includes, in its rear portion, three flanges 90*c* and spring holding members 90*d*. The flanges 90*c*, at multiple (12) positions, semi-circularly protrude radially outward with respect to the front portion. The protrusions are connected at their radially inward portions into sets of a predetermined number of (four) semi-circular protrusions.

The spring holding members 90*d* are columns protruding rearward from the semi-circular protrusions on the flanges 90*c*. The flanges 90*c* are separate from each other in the circumferential direction by troughs 90*e* that are recesses circumferentially inward from the outer contours of the flanges 90*c*.

Ribs 90*f* are formed between predetermined spring holding members 90*d*. The ribs 90*f* protrude rearward from the rear end of the spring holder base 90*a*. The ribs 90*f* protrude rearward to the same height as the spring holding members 90*d*. The ribs 90*f* regulate radially outward movement of the components arranged radially inward, and hold and prevent the components from slipping off.

The lower flange 90*c* includes a protruding piece 90*g* protruding radially outward between the lower semi-circular protrusions.

Figure 11:
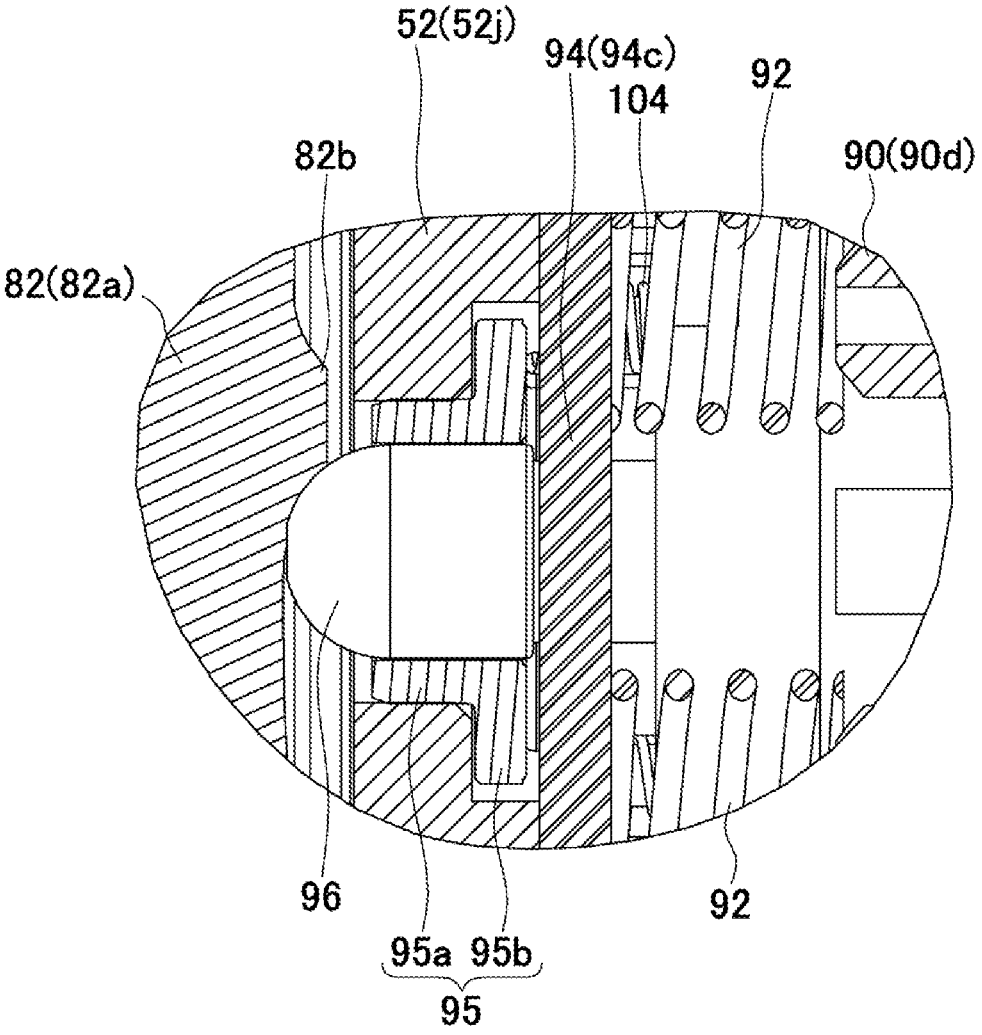
FIG. 11 is a cross-sectional view taken along line D-D in FIG. 8.

As shown in FIG. 11, each spring holding member 90*d* holds a clutch pin coil spring 92. The clutch pin coil spring 92 is an elastic member for a clutch pin and for urging the internal gear 82. A single washer 94 is located behind each clutch pin coil spring 92. The washer 94 has the same shape as the flanges 90*c*. The front end of each clutch pin coil spring 92 comes in contact with the rear surface of the flange 90*c* on the spring holder 90. The rear end of each clutch pin coil spring 92 comes in contact with the front surface of the washer 94.

The washer 94 includes multiple (12) protrusions 94*b*. The protrusions 94*b* are semicircles protruding radially outward from an annular washer base 94*a*. Six extensions 94*c* in total are each located between adjacent semi-circular protrusions on the washer 94 protruding radially outward. Each extension 94*c* is an arc extending radially inward from a radially inner edge of the washer base 94*a*. Similarly to the troughs 90*e* on the spring holder 90, the washer 94 has three troughs 94*d* in total.

As shown in FIGS. 8 and 9, the spring holder 90, the clutch pin coil springs 92, and the washer 94 are located between the inner cylinder 52*g* and the outer cylinder 52*a* in the gear housing 52. A front inner surface of the outer cylinder 52*a* has the same contour as the flange 90*c* or the washer 94. The flanges 90*c* and the protruding piece 90*g* lock the spring holder 90 in a nonrotatable manner. The protrusions 94*b* lock the washer 94 in a nonrotatable manner. In addition to the protrusions 94*b*, the washer 94 may include protruding pieces between, for example, the protrusions 94*b* to lock the washer 94 in a nonrotatable manner.

In the gear housing 52, an annular wall 52*j* extends vertically and laterally to connect the inner cylinder 52*g* to the outer cylinder 52*a*. The wall 52*j* has a front surface shaped in correspondence with the flanges 90*c* or the washer 94.

As shown in FIG. 11, the wall 52*j* has circular holes behind extensions 94*c* on the washer 94. Each hole receives a columnar clutch pin 96 from the front through a cylindrical clutch pin sleeve 95.

Each clutch pin sleeve 95 includes a cylindrical clutch pin sleeve base 95*a* and a pair of flanges 95*b*. The flanges 95*b* protrude radially outward from the outer surface of the front end of the clutch pin sleeve base 95*a*. For adjacent clutch pin sleeves 95, the flange 95*b* on the clutch pin sleeve 95 located forward in the circumferential direction faces the flange 95*b* on the clutch pin sleeve 95 located rearward in the circumferential direction. The flanges 95*b* increase the area supported by the gear housing 52. The clutch pin sleeves 95 and the clutch pins 96 can thus be shorter in the front-rear direction while maintaining the support strength.

Each clutch pin 96 is in column shape with a rounded rear end. The clutch pin 96 has its front portion received in the clutch pin sleeve base 95*a* and thus is integrally held by the clutch pin sleeve 95.

The front end of each clutch pin sleeve 95 and the front end of each clutch pin 96 are in contact with the rear surface of the washer 94.

The rear end of each clutch pin 96 may come in contact with the front surface of the cylindrical internal teeth portion 82*a* of the internal gear 82.

A clutch mechanism 97 includes the spring holder 90, the clutch pin coil springs 92, the washer 94, the clutch pin sleeves 95, and the clutch pins 96. The clutch mechanism 97 may include the cam projections 82*b*. At least the clutch pin sleeves 95 or the washer 94 may be eliminated.

As shown in FIGS. 8 and 9, a support ring 100 and a pin holder 102 are located radially inside the spring holder 90. The pin holder 102 is located behind the support ring 100.

The support ring 100 includes a support ring base 100*a* including multiple (three) cam projections 100*b* (pin holder cams) on the front end at circumferentially equal intervals. The support ring base 100*a* is in cylindrical shape having an axis extending in the front-rear direction. The cam projections 100*b* are trapezoidal and protrude more frontward than other portions. Multiple (three) protruding pieces 100*c* are each circumferentially located between the cam projections 100*b*. The protruding pieces 100*c* protrude rearward from the rear end of the support ring base 100*a*.

The pin holder 102 includes a pin holder base 102*a* including, in its front end, recesses 102*b*, multiple (six) spring holding members 102*c*, and multiple (three) pin holding members 102*d*. The pin holder base 102*a* is in cylindrical shape having an axis extending in the front-rear direction. The recesses 102*b* correspond to the protruding pieces 100*c* on the support ring 100. The spring holding members 102*c* protrude radially inward and rearward from the inner surface of the pin holder base 102*a*. The multiple (six) spring holding members 102*c* are located at circumferentially equal intervals. The pin holding members 102*d* protrude radially outward from the outer surface of the pin holder base 102*a*. The multiple (three) pin holding members 102*d* are located at circumferentially equal intervals. The recesses 102*b* are circumferentially displaced from the pin holding members 102*d*.

Each spring holding member 102*c* includes a rearward protrusion to receive the front end of a pin holder coil spring 104 as an elastic member. The rear portions of the pin holder coil springs 104 are received in recesses 52*k* shown in FIG. 12. The recesses 52*k* are columnar and recede rearward from the front surface of the wall 52*j* of the gear housing 52. The six recesses 52*k* in total are located in correspondence with the spring holding members 102*c*. The pin holder coil springs 104 urge the pin holder 102 forward.

As shown in FIG. 9, each pin holding member 102*d* holds the front end of an internal gear lock pin 106. The internal gear lock pins 106 are in columnar shape extending in the front-rear direction. Each internal gear lock pin 106 has an annular groove 106*a* on its front end. Each groove 106*a* receives a bifurcated distal end of the pin holding member 102*d*. Each pin holding member 102*d* and each internal gear lock pin 106 extend between corresponding clutch pin coil springs 92 and through the outside of the troughs 90*e* and 94*d* on the spring holder 90 and the washer 94. Each internal gear lock pin 106 passes through a corresponding pin hole 521 in the wall 52*j* of the gear housing 52. The rear end of each internal gear lock pin 106 is movable forward and rearward relative to a radially outward surface of the third internal gear 82.

A drill switch ring 108 is located in front of the support ring 100 and radially inside the change ring 54 and the spring holder 90. The drill switch ring 108 is annular and is formed from a resin.

As shown in FIGS. 8 to 10B, the drill switch ring 108 includes a cylindrical drill switch ring base 108*a* and three cam recesses 108*b*. At the rear of the drill switch ring base 108*a*, the cam recesses 108*b* are trapezoidal and recede frontward in correspondence with the cam projections 100*b* on the support ring 100. The support ring 100 is located behind the cam recesses 108*b*.

The drill switch ring 108 includes a lock lever receiving recess 108*c* (locking member receiving recess). The lock lever receiving recess 108*c* recedes rearward from the front of the drill switch ring base 108*a* to have the same width (circumferential dimension) as the lock lever base 89*a*. The lock lever receiving recess 108*c* allows the lock lever 89 to pass through.

The drill switch ring 108 has multiple (three) engagement projections 108*d*. The engagement projections 108*d* protrude radially inward from the inner surface of the drill switch ring base 108*a*.

Figure 6:
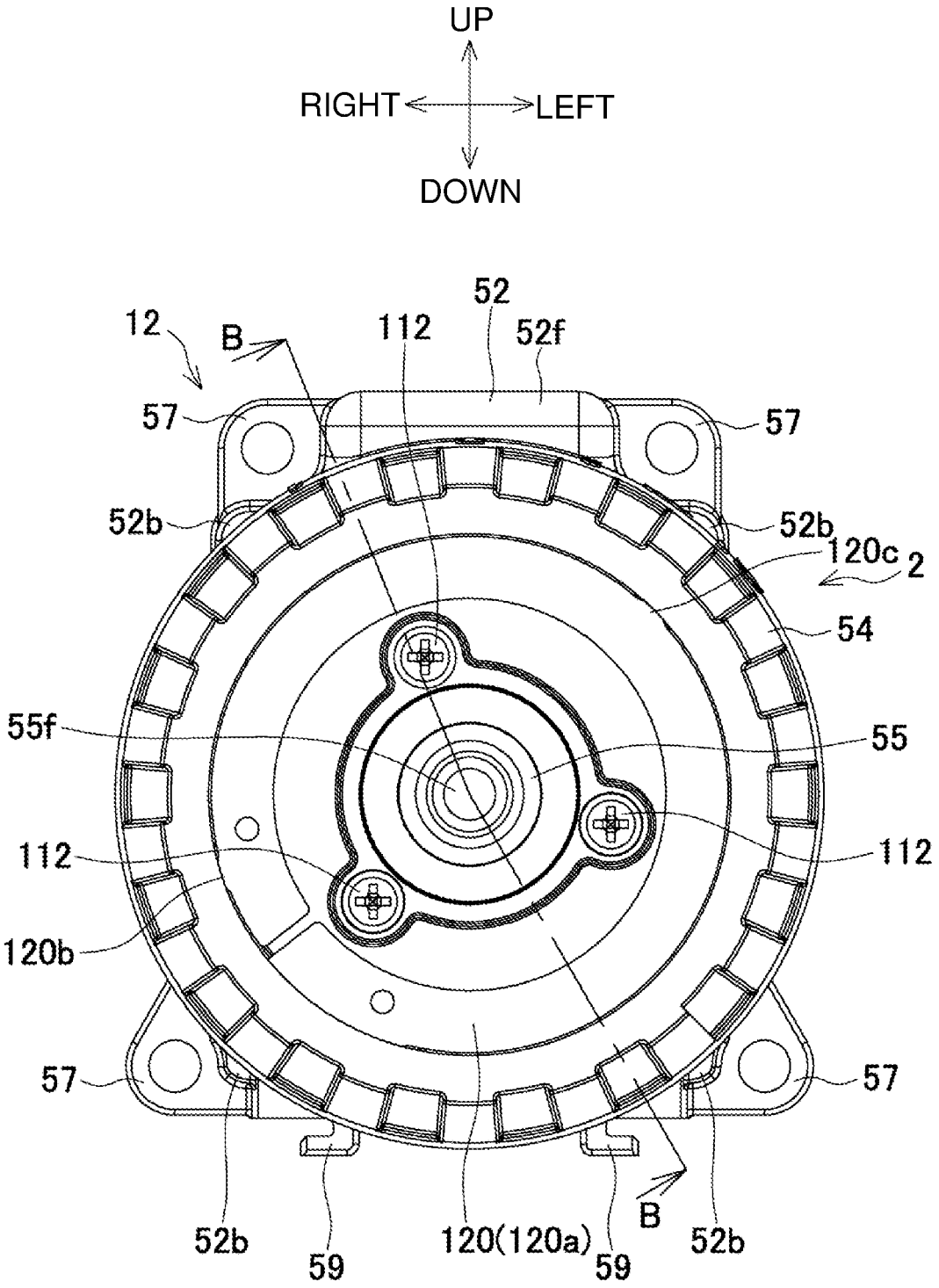
FIG. 6 is a front view of the gear assembly in FIG. 5.
Figure 7:
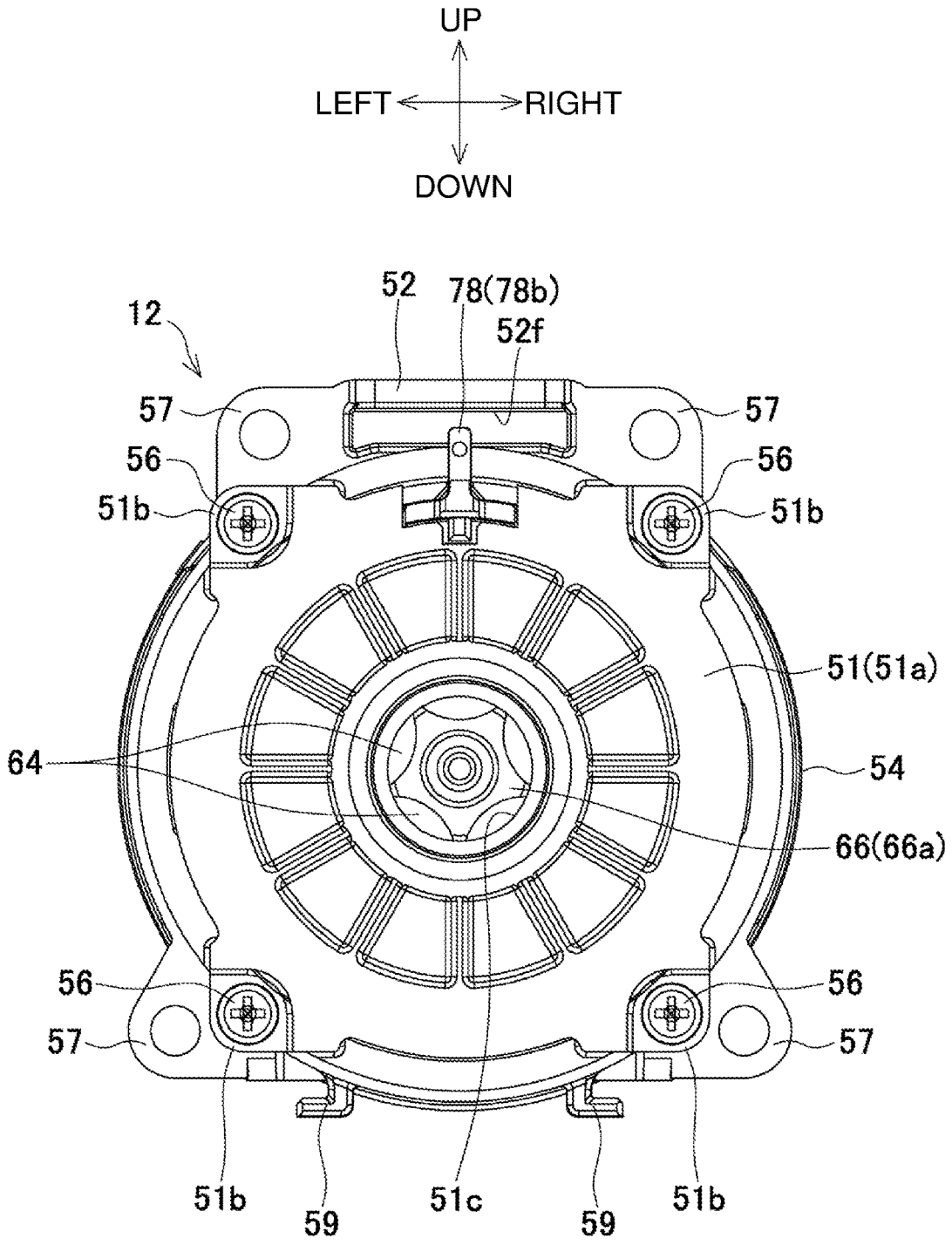
FIG. 7 is a rear view of the gear assembly in FIG. 5.

The change ring 54 is located radially outward from the inner cylinder 52*g* in the gear housing 52 and is attached in an axially rotatable manner. As shown in FIG. 6, the front end of the inner cylinder 52*g* receives an annular cam plate 110 fastened with multiple (three) screws 112. The cam plate 110 is located in front of the rib 54*b* on the change ring 54. The change ring 54 is placed between the cam plate 110 and a front end opening of the outer cylinder 52*a* in the gear housing 52.

As shown in FIGS. 8 to 10B, the cam plate 110 includes a front cam plate 110*a*, a rear cam plate 110*b*, and screw holes 110*c*. The front cam plate 110*a* is a disk with an opening. The rear cam plate 110*b* is a disk with an opening behind the front cam plate 110*a*, and has a smaller diameter than the front cam plate 110*a*. The screw holes 110*c* extend through the front cam plate 110*a* and the rear cam plate 110*b* to receive the screws 112.

The front cam plate 110*a* has a notch 110*d*, a notch 110*e*, and notches 110*f* on its circumference. The notches 110*d* and 110*e*, and the notches 110*f* recede radially inward from the circumference. The middle portion of the leaf spring 87 is received in any one of the notches 110*d* to 110*f*.

The circumference of the rear cam plate 110*b* defines the shape of a cam including a smaller diameter portion 110*g*, a larger diameter portion 110*h*, and a slope 110*i*. The slope 110*i* connects the smaller diameter portion 110*g* to the larger diameter portion 110*h*. The follower 89*b* in the lock lever 89 is in contact with and can follow the circumference of the rear cam plate 110*b*.

The rear cam plate 110*b* includes the smaller diameter portion 110*g* (upper left in FIG. 10A) opposite to the notches 110*d* and 110*e* on the front cam plate 110*a* across the center. More specifically, the notch 110*e* is located opposite to an end of the smaller diameter portion 110*g* adjacent to the slope 110*i*. The notches 110*f* are located in an area from a position opposite to an end of the larger diameter portion 110*h* adjacent to the slope 110*i* (bottom in FIG. 10A) to a position opposite to the other end of the larger diameter portion 110*h* adjacent to the smaller diameter portion 110*g* (right in FIG. 10A).

The front end of the inner cylinder 52*g* has multiple screw holes 52*m*. The screw holes 52*m* are located in correspondence with the screw holes 110*c* to receive the screws 112.

As shown in FIG. 10B, the central axis of the spring 89S is located rearward from the central axis of the lock lever 89. This prevents the urging force of the spring 89S from being applied away from the cam plate 110, and thus allows the lock lever 89 to operate in a reliable manner following the circumferential cam shape of the rear cam plate 110*b*.

A cover ring 120 formed from a thin metal plate is located in front of the circumference of the cam plate 110.

The cover ring 120 includes an annular cover ring base 120*a*, a tab piece 120*b*, and an engagement piece 120*c*. The tab piece 120*b* protrudes radially outward from a circumferential portion of the cover ring base 120*a*. The engagement piece 120*c* protrudes radially outward at a position opposite to the tab piece 120*b*. The cover ring 120 is locked in a nonrotatable manner with respect to the change ring 54 by the tab piece 120*b* and the engagement piece 120*c*. The cover ring 120 covers the circumference of the cam plate 110.

The tab piece 120*b* is shaped to correspond to the recess 54*d* on the change ring 54, and has a slit. The recess 54*d* receives the tab piece 120*b*.

As shown in FIG. 12, spaces face each other between the tab members 86*c* on the third carrier 86. Rollers 130 are located in two facing spaces (right and left spaces in the figure).

Lock cams 132 are located in other two facing spaces (upper and lower spaces in the figure). Each lock cam 132 includes a cylinder 132*a* and a pair of protruding pieces 132*b*. The protruding pieces 132*b* protrude radially outward from the top and the bottom of the cylinder 132*a*. Each protruding piece 132*b* is located between the tab members 86*c*. A center hole of the cylinder 132*a* in the lock cam 132 is connected to the rear step 55*d* in the spindle 55 using a spline. This integrates the lock cam 132 and the spindle 55. The lock cam 132 rotates together with the third carrier 86 with each tab member 86*c*.

A cylindrical lock ring 134 is mounted on the front of the lock cam 132. The lock ring 134 is fixed inside the inner cylinder 52*g* in the gear housing 52. The lock ring 134 includes a cylindrical lock ring base 134*a*, an inner flange 134*b*, an outer flange 134*c*, and multiple (three) protrusions 134*d*. The inner flange 134*b* protrudes inward from the inner surface of the front end of the lock ring base 134*a*. The outer flange 134*c* protrudes outward from the outer surface of the rear end of the lock ring base 134*a*. The protrusions 134*d* protrude radially outward and frontward from the side surface of the lock ring base 134*a*. The multiple (three) protrusions 134*d* are located at circumferentially equal intervals. The rollers 130, the lock cam 132, and the tab members 86*c* on the third carrier 86 are located behind the inner flange 134*b*. The protrusions 134*d* are received on the inner surface of the inner cylinder 52*g* in the gear housing 52 with the corresponding shape to fasten the lock ring 134 in a non-rotatable manner.

As shown in FIGS. 8 and 9, a spindle rear bearing 138 and a spindle front bearing 140 hold the spindle 55 in a manner movable in the front-rear direction and axially rotatable. The spindle rear bearing 138 is located in front of the lock ring 134. The spindle front bearing 140 is located radially outside the front step 55*b*.

The spindle front bearing 140 is located outside the front step 55*b* in the spindle 55.

A spindle coil spring 144, which is an elastic member, is located between the spindle front bearing 140 and the spindle flange 55*a*. The rear surface of the spindle flange 55*a* and the spindle coil spring 144 are flared to have a slope shape having a gradually wider diameter toward the front.

A clip 146 presses the front surface of the outer ring of the spindle rear bearing 138. The clip 146 is received in a groove on the inner surface of the inner cylinder 52*g* in the gear housing 52.

A vibration mechanism 150 is located between the spindle front bearing 140 and the clip 146. The vibration mechanism 150 includes a first vibration cam 152 and a second vibration cam 154. The first vibration cam 152 and the second vibration cam 154 are annular and held by the middle step 55*c* in the spindle 55. To indicate the continuity of FIGS. 14 and 15, the two figures redundantly show the second vibration cam 154. The vibration driver drill 1 actually includes a single second vibration cam 154.

The first vibration cam 152 includes a cylindrical first vibration cam base 152*a* having a first cam surface 152*b* on its rear surface. The first cam surface 152*b* has multiple cam teeth. The first vibration cam 152 is integrally fixed to the spindle 55 with a circlip 156. The circlip 156 is fixed to the outer surface of the front end of the middle step 55*c* in the spindle 55. The spindle 55 in a normal state is urged by the spindle coil spring 144 frontward until the circlip 156 comes in contact with the inner ring of the spindle front bearing 140.

The second vibration cam 154 includes an annular second vibration cam base 154*a* having a second cam surface 154*b* on its front surface. The second cam surface 154*b* has multiple cam teeth. The second vibration cam base 154*a* includes multiple (three) tabs 154*c* on the rear surface at circumferentially equal intervals. The tabs 154*c* protrude rearward. The second vibration cam 154 is received on the spindle 55 in a circumferentially movable manner.

A ball holding washer 160, multiple steel balls 162, and a ball receiving washer 164 are located between the second vibration cam 154 and the clip 146.

As shown in FIGS. 8 and 9, the ball holding washer 160 is adjacent to the rear surface of the second vibration cam base 154*a*. The ball holding washer 160 is a bowl-shaped member having an inner circumference at its front end and an outer circumference at its rear end. The ball holding washer 160 holds and circumferentially aligns the balls 162 on its curved rear surface.

The ball receiving washer 164 includes an annular ball receiving washer base 164*a*, multiple (three) protruding portions 164*b*, and narrowed portions 164*c*. The protruding portions 164*b* protrude radially outward from the washer base 164*a*. The multiple (three) protruding portions 164*b* are located at circumferentially equal intervals. The narrowed portions 164*c* are each circumferentially located between the protruding portions 164*b*. The protruding portions 164*b* are received in recesses on the inner surface of the inner cylinder 52*g* in the gear housing 52 to lock the ball receiving washer 164 in a nonrotatable manner.

The vibration mechanism 150 may include at least the circlip 156, the ball holding washer 160, the balls 162, or the ball receiving washer 164.

As shown in FIGS. 8 and 9, a vibration switch ring 170, which is formed from a metal (sintered metal), is located radially inward from the drill switch ring 108. A set of (three) vibration switch levers 172 (vibration switch members, part of vibration switch means) is located behind the vibration switch ring 170. Each vibration switch lever 172 is an arc of one third of the entire circumference. A washer 174 is located behind the vibration switch levers 172.

The vibration switch ring 170 includes a cylindrical vibration switch ring base 170*a*, multiple (three) engagement recesses 170*b*, and multiple (three) cam recesses 170*c*. The engagement recesses 170*b* recede radially inward from the front end of the vibration switch ring base 170*a*. The multiple (three) engagement recesses 170*b* are located at circumferentially equal intervals. The cam recesses 170*c* recede frontward from the rear end of the vibration switch ring base 170*a*. The cam recesses 170*c* are located at the circumferentially same positions as the engagement recesses 170*b*. The engagement recesses 170*b* receive and engage with the engagement projections 108*d*. The engagement projections 108*d* are located in correspondence with the drill switch ring 108. The vibration switch ring 170 rotates integrally with the drill switch ring 108.

The vibration switch levers 172 are formed from a metal (injection metal). Each vibration switch lever 172 includes a vibration switch lever base 172*a*, a raised portion 172*b* (vibration switch cam), and a vibration switch tab 172*c*. The vibration switch lever base 172*a* is open frontward, and has a U-shaped cross section. The raised portion 172*b* on the vibration switch lever base 172*a* is raised frontward in correspondence with the cam recess 170*c*. The vibration switch tab 172*c* protrudes radially inward and rearward from the middle of the radially internal surface of each vibration switch lever base 172*a*. The vibration switch levers 172 are located radially outside the inner cylinder 52*g* to have the vibration switch tabs 172*c* received in multiple (three) radial holes 52*o* (through-holes). The holes 52*o* are open at circumferentially equal intervals in the middle of the inner cylinder 52*g* in the gear housing 52 in the front-rear direction. The vibration switch levers 172 are located inside the support ring 100.

The vibration switch tabs 172*c* are located radially outside the narrowed portions 164*c* of the ball receiving washer 164. More specifically, the ball receiving washer 164 includes the narrowed portions 164*c* to avoid contact with the vibration switch tabs 172*c*.

The vibration switch tabs 172*c* are movable forward and rearward between the tabs 154*c* protruding rearward at the rear of the second vibration cam base 154*a*.

As shown in FIGS. 9 and 12, pin holes 52*p* extend in the front-rear direction in portions between the three holes 52*o* in the inner cylinder 52*g* in the gear housing 52 and circumferentially adjacent to the six recesses 52*k* receiving the pin holder coil springs 104. Each pin hole 52*p* receives a pin 180 from the rear. Each pin hole 52*p* has an enlarged front portion larger than its rear portion. A vibration switch lever coil spring 182, which is an elastic member, is located between the enlarged portion and a front portion of each pin 180. The front ends of the vibration switch lever coil springs 182 come in contact with the washer 174 behind the vibration switch levers 172. The vibration switch lever coil springs 182 urge the washer 174 and the vibration switch levers 172 forward.

More specifically, three or more (six) vibration switch lever coil springs 182 as urging members are aligned circumferentially. A single vibration switch lever 172 comes in contact with multiple (two) vibration switch lever coil springs 182 for urging (pressing) the vibration switch lever 172.

The rear ends of the pins 180 are located in front of the outer flange 134*c* on the lock ring 134.

Figure 16B:
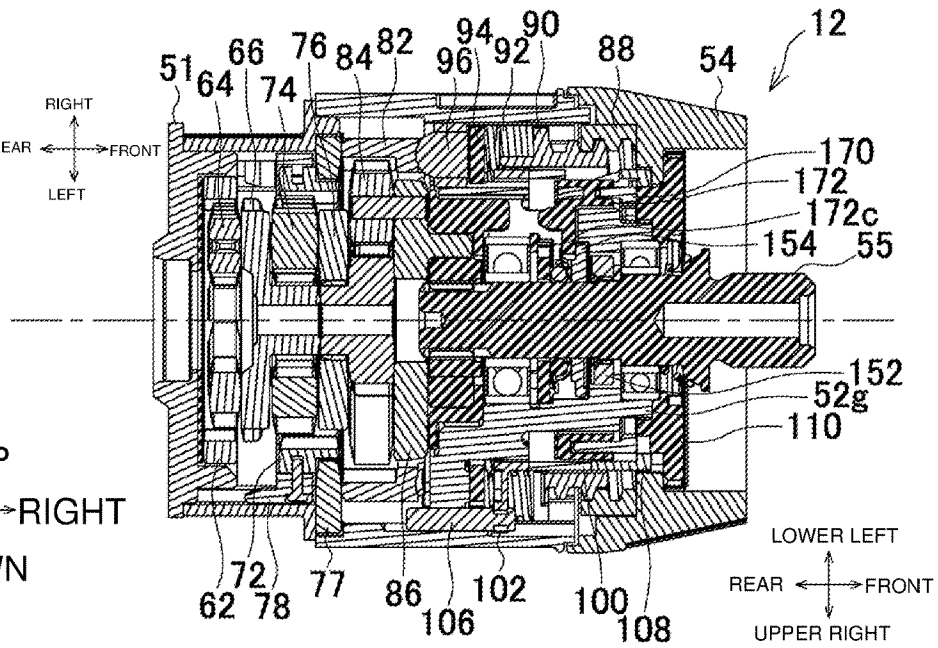
FIG. 16B is a cross-sectional view taken along line H-H in FIG. 16A.
Figure 16A:
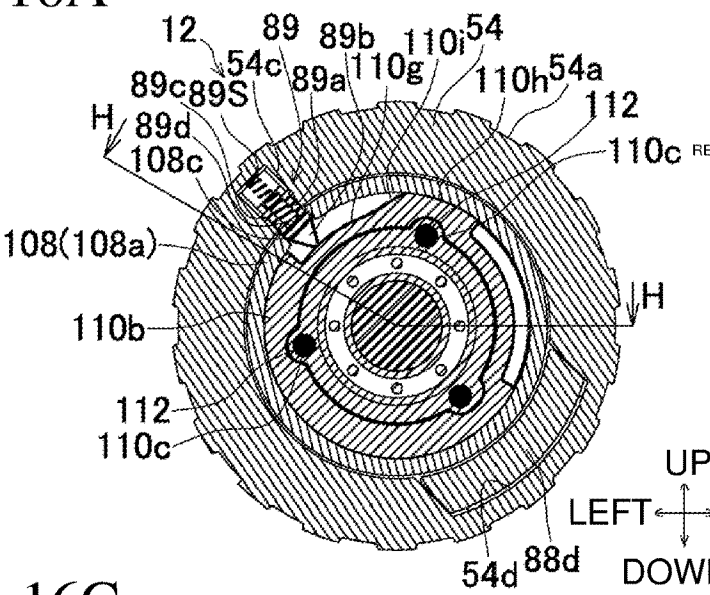
FIG. 16A is a diagram showing a left portion similar to FIG. 10A in a vibration drill mode.
Figure 16C:
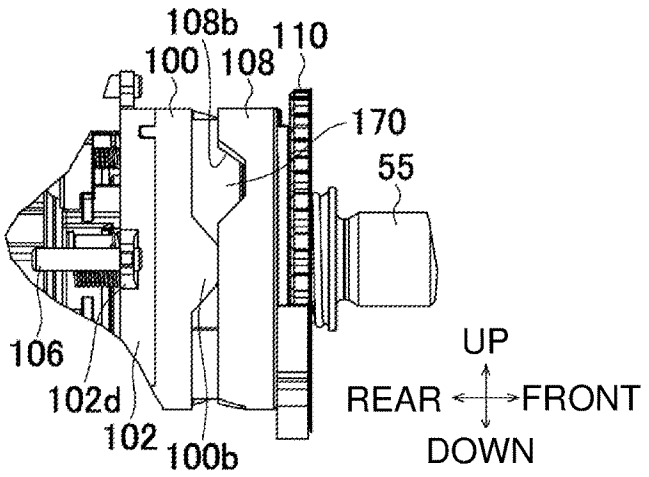
FIG. 16C is an exploded perspective view of the front portion of the gear assembly shown in FIG. 5 excluding a change ring, a clutch switch ring, and a spring holder.

As shown in FIGS. 16A to 16C, at the rotational position of the change ring 54 (as in FIG. 10A), the leaf spring 87 has the middle portion received in the notch 110*d*. In this state, the rear end of the drill switch ring 108 excluding the cam recesses 108*b* comes in contact with the front ends of the cam projections 100*b* on the support ring 100 to move the support ring 100 rearward. The pin holder 102 then moves rearward, and the internal gear lock pins 106 enter between the circumferential protrusions 82*c* on the radially outward surface of the third internal gear 82. The internal gear lock pins 106 come in contact with the side surfaces of the protrusions 82*c* to prevent the third internal gear 82 from rotating. This locks the internal gear 82 (clutch nonoperational state) although the clutch pins 96 press the internal gear 82.

At the rotational position, the vibration switch levers 172 have the raised portions 172*b* received in the corresponding cam recesses 170*c* on the vibration switch ring 170 to move forward. The vibration switch tabs 172*c* move forward and enter between the tabs 154*c* on the second vibration cam 154. In this state, the vibration switch tabs 172*c* are caught by the tabs 154*c* to prevent the second vibration cam 154 from rotating. Thus, the vibration switch levers 172 prevent the second vibration cam 154 from rotating with the vibration switch tabs 172*c*. When the spindle 55 rotates, the first vibration cam 152 rotates integrally with the spindle 55, whereas the second vibration cam 154 does not rotate. When the spindle 55 moves rearward, the first cam surface 152*b* rotates in contact with the locked second cam surface 154*b*, causing the spindle 55 to vibrate axially (vibration mechanism operational state). The vibration driver drill 1 includes the vibration switch unit including the vibration switch ring 170, the vibration switch levers 172, the pins 180, and the vibration switch lever coil springs 182.

At this rotational position, the electric vibration driver drill 1 enters a vibration drill mode in which the clutch does not operate and no vibration is generated.

When the vibration switch levers 172 are moved forward, the rear end of the vibration switch ring base 170*a* relatively enters the vibration switch lever bases 172*a*, increasing the degree of contact between the vibration switch levers 172, and between the vibration switch ring 170 and the vibration switch levers 172. This achieves tight contact between components frontward from the vibration switch levers 172 (inside the inner cylinder 52*g* in the gear housing 52), and prevents dust and leakage of grease used inside the components.

The vibration switch lever coil springs 182 urge the vibration switch levers 172 forward to allow the raised portions 172*b* to smoothly enter the cam recesses 170*c*.

At this rotational position, the follower 89*b* in the lock lever 89 is received in the smaller diameter portion 110*g* of the rear cam plate 110*b*, and the lock lever base 89*a* is received in the lock lever receiving recess 108*c* on the drill switch ring 108. Thus, the change ring 54 can integrally rotate with the drill switch ring 108.

Figure 17B:
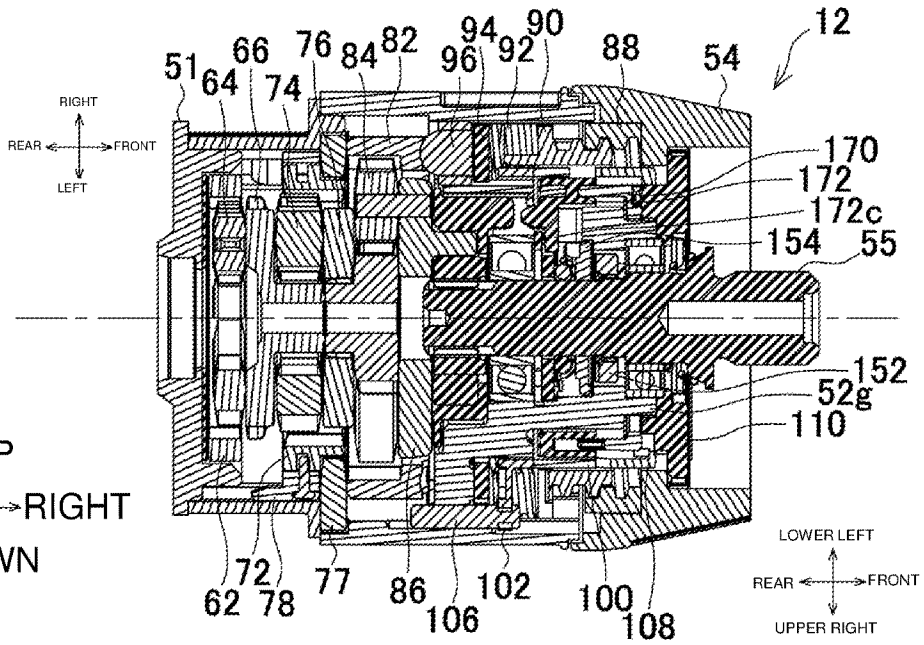
FIGS. 17A to 17C are diagrams similar to FIGS. 16A to 16C in a drill mode.
Figure 17A:
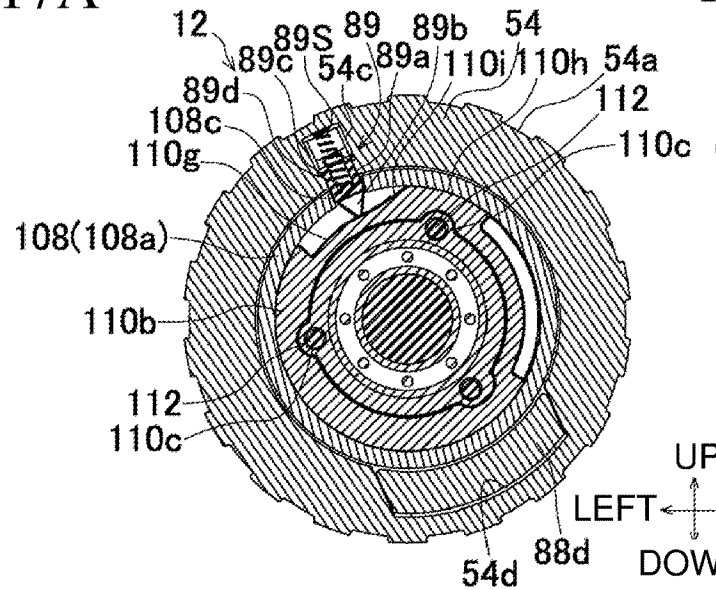
Figure 17C:
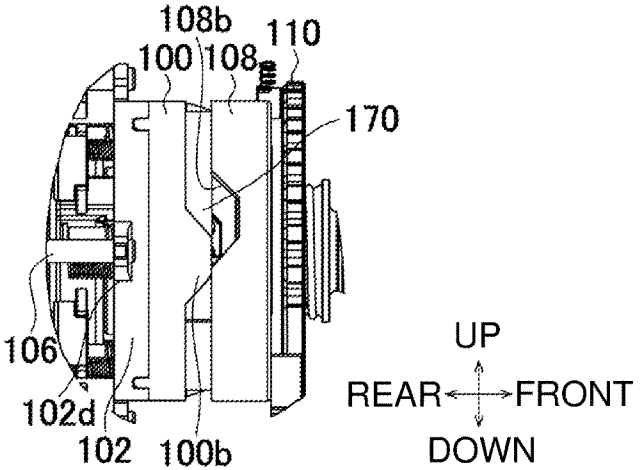

When the change ring 54 is rotated from the above rotational position until the middle portion of the leaf spring 87 is received in the notch 110*e*, the follower 89*b* reaches an end of the smaller diameter portion 110*g* adjacent to the slope 110*i* as shown in FIGS. 17A to 17C.

At this rotational position, the rear end of the drill switch ring 108 excluding the cam recesses 108*b* comes in contact with the front ends of cam projections 100*b* on the support ring 100. The support ring 100, the pin holder 102, and the internal gear lock pins 106 remain rearward, locking the internal gear 82 (clutch nonoperational state).

At this rotational position, the raised portions 172*b* on the vibration switch levers 172 exit from the cam recesses 170*c* on the vibration switch ring base 170*a*, and the front ends of the raised portions 172*b* come in contact with the vibration switch ring base 170*a* excluding the cam recesses 170*c*. The vibration switch levers 172 are moved rearward against the urging force from the vibration switch lever coil springs 182. This moves the vibration switch tabs 172*c* rearward from between the tabs 154*c* on the second vibration cam 154, allowing rotation of the second vibration cam 154. When the spindle 55 rotates, the first vibration cam 152 rotates integrally with the spindle 55 to rotate the second vibration cam 154 with the first cam surface 152*b* and the second cam surface 154*b*. However, the second vibration cam 154 is received on the spindle 55 in a rotatable manner to generate no vibration (vibration mechanism nonoperational state).

More specifically, at this rotational position, the vibration driver drill 1 enters a drill mode in which the clutch does not operate and no vibration is generated.

When the change ring 54 is rotated from the above rotational position until the middle portion of the leaf spring 87 is received in the notch 110*f* (closest to the notch 110*e* and circumferentially opposite to the notch 110*d* across the notch 110*e*), the follower 89*b* climbs the slope 110*i* to move from the smaller diameter portion 110*g* to the larger diameter portion 110*h*. Before the follower 89*b* reaches the larger diameter portion 110*h*, the lock lever base 89*a* exits radially outwardly from the lock lever receiving recess 108*c* on the drill switch ring 108.

Figure 18B:
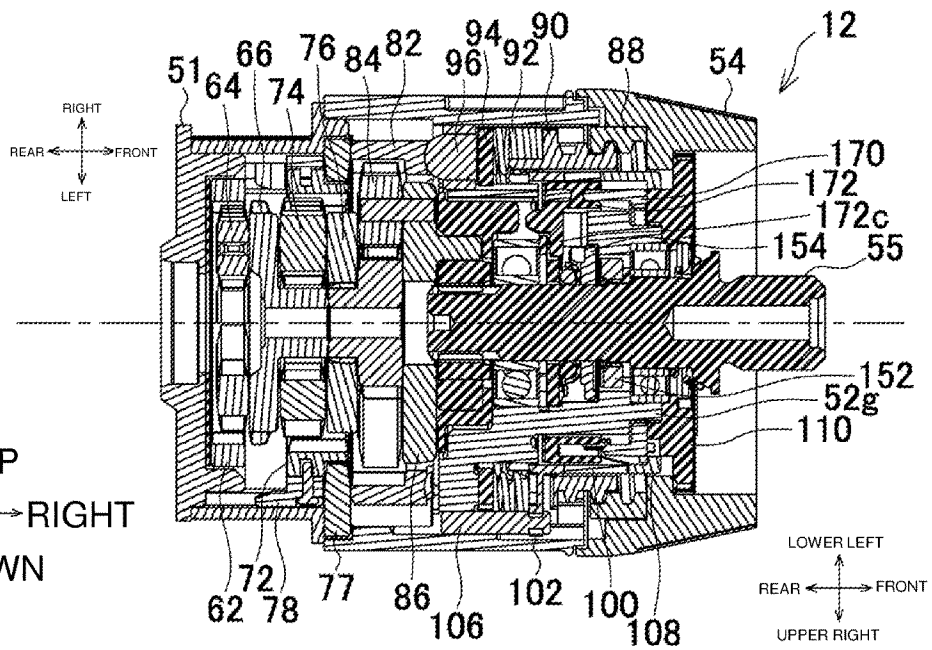
FIGS. 18A to 18C are diagrams similar to FIGS. 16A to 16C in an intermediate state between the drill mode and a clutch mode (with a maximum clutch setting).
Figure 18A:
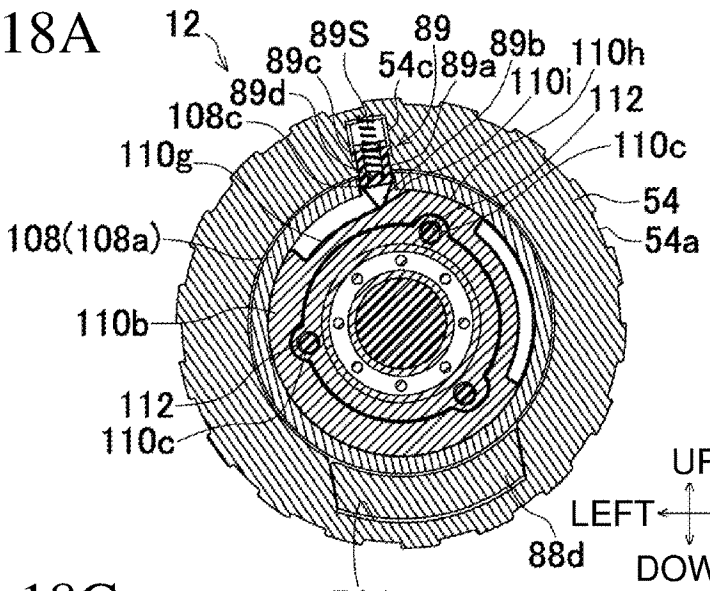
Figure 18C:
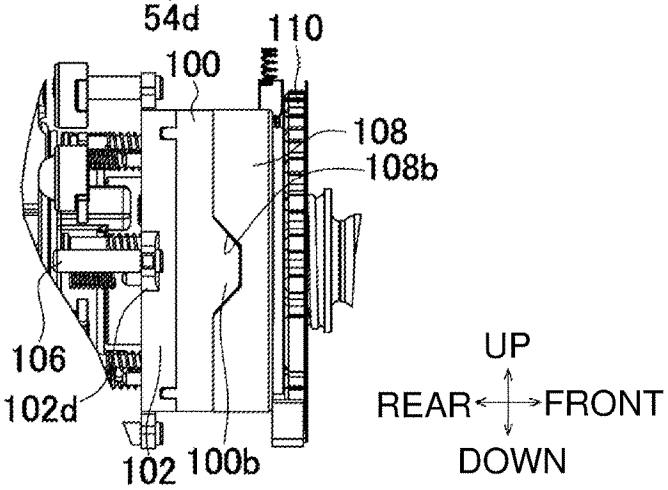
Figure 19B:
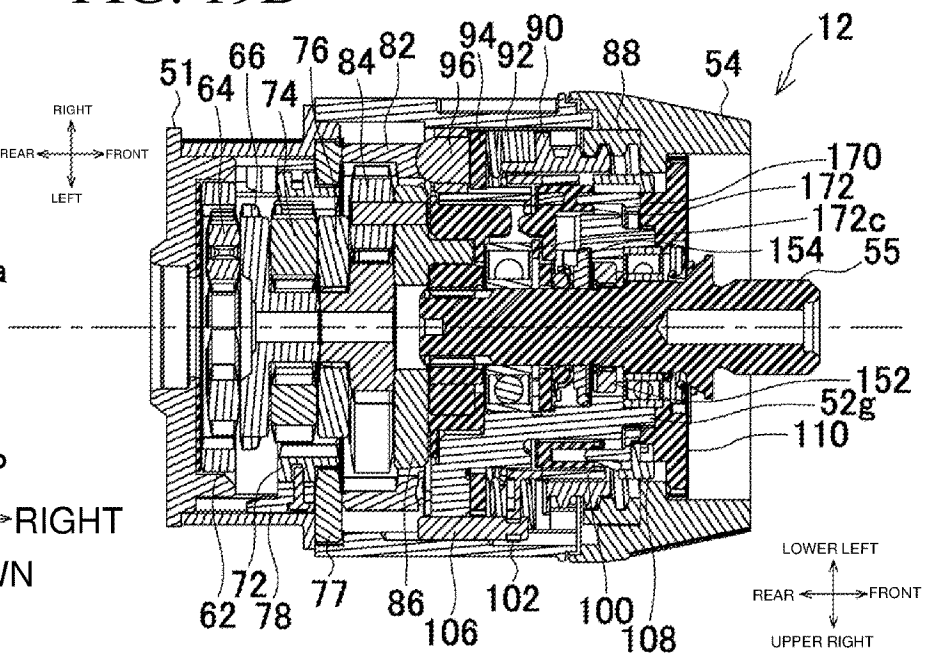
FIGS. 19A to 19C are diagrams similar to FIGS. 16A to 16C in a state between the drill mode and the clutch mode (with a maximum clutch setting) immediately before a lock lever is disengaged.
Figure 19A:
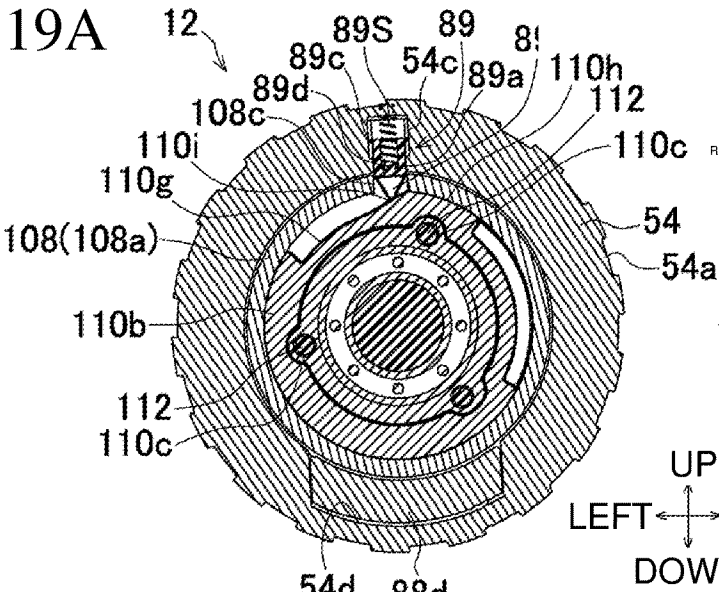
Figure 19C:
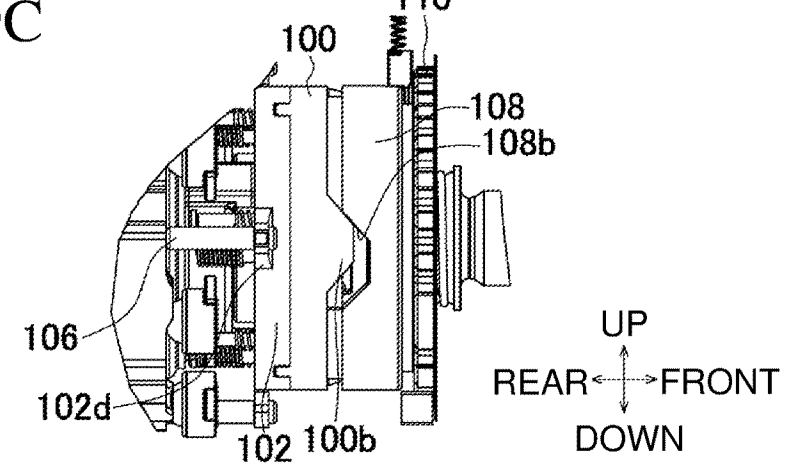

FIGS. 18A to 18C show the follower 89*b* climbing the slope 110*i*. FIGS. 19A to 19C show the follower 89*b* at a higher (more radially outward) position on the slope 110*i* than in FIGS. 18A to 18C and the lock lever base 89*a* immediately before exiting from the lock lever receiving recess 108*c*.

As shown in FIGS. 18A to 18C, the slope 110*i* causes the lock lever 89 to disengage from the drill switch ring 108. The cam recesses 108*b* on the drill switch ring 108 receive the cam projections 100*b* on the support ring 100 (refer to FIG. 18C). This moves the support ring 100 and the pin holder 102 forward, causing the internal gear lock pins 106 to retract forward from between the protrusions 82*c* on the third internal gear 82.

As shown in FIGS. 19A to 19C, the cam recess 108*b* on the drill switch ring 108 is passing the cam projection 100*b* on the support ring 100 (refer to FIG. 19C) immediately before the lock lever base 89*a* exits from the lock lever receiving recess 108*c*.

When the follower 89*b* moves from the smaller diameter portion 110*g* to the larger diameter portion 110*h*, the lock lever base 89*a* of the lock lever 89 exits from the lock lever receiving recess 108*c* on the drill switch ring 108, causing the drill switch ring 108 not to rotate integrally with the change ring 54.

When the lock lever base 89*a* exits from the lock lever receiving recess 108*c*, the drill switch ring 108 returns to a rotational position at which the cam recesses 108*b* receive the cam projections 100*b* on the support ring 100 (refer to FIG. 20C) under the urging force from the pin holder coil springs 104 applied to the support ring 100 through the pin holder 102. This moves the support ring 100 and the pin holder 102 forward, and causes the internal gear lock pins 106 to retract from the radially outward surface of the third internal gear 82. Thus, the internal gear lock pins 106 no longer prevent the third internal gear 82 from rotating.

The pin holder coil springs 104 urge the support ring 100 through the pin holder 102 to allow the cam projections 100*b* to smoothly enter the cam recesses 108*b*. The urging force of the pin holder coil springs 104 retains the drill switch ring 108 at this rotational position until the change ring 54 is reverse-rotated to cause the lock lever 89 to re-enter the lock lever receiving recess 108*c* and receive a reverse rotational force. The above reverse rotation causes the cam projections 100*b* to exit from the cam recesses 108*b* against the urging force of the pin holder coil springs 104, moving the pin holder 102 rearward.

Figure 20B:
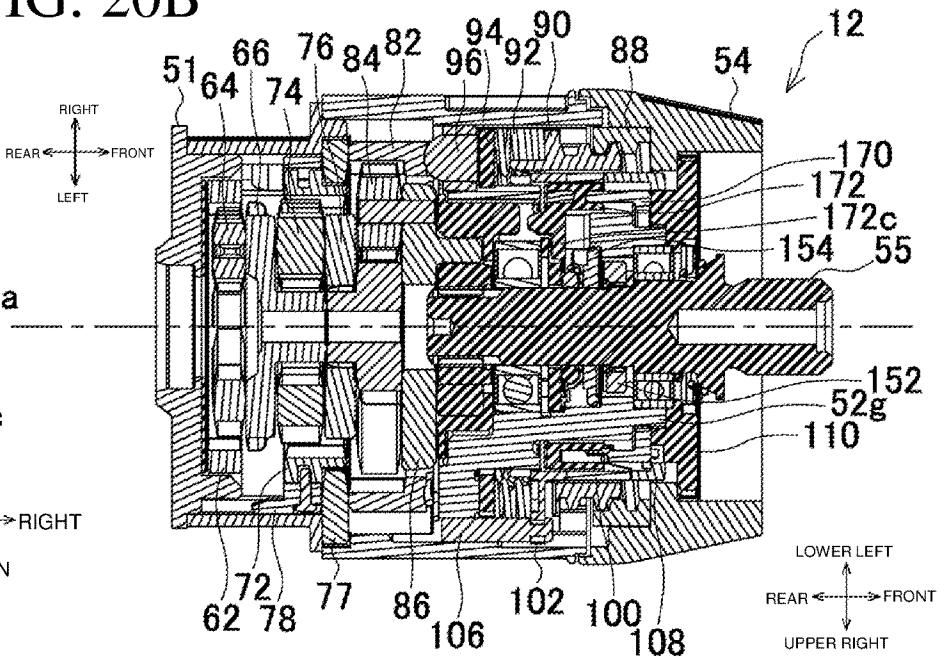
FIGS. 20A to 20C are diagrams similar to FIGS. 16A to 16C in the clutch mode (with a maximum clutch setting).
Figure 20A:
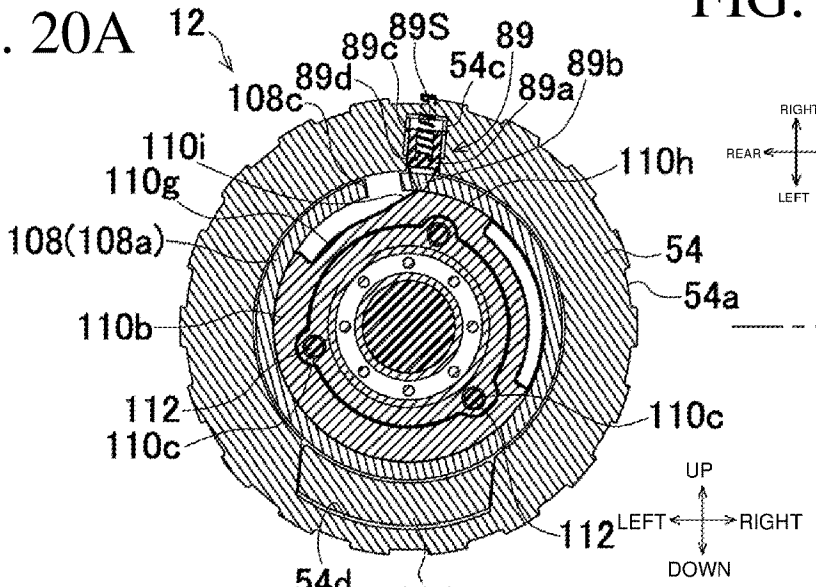
Figure 20C:
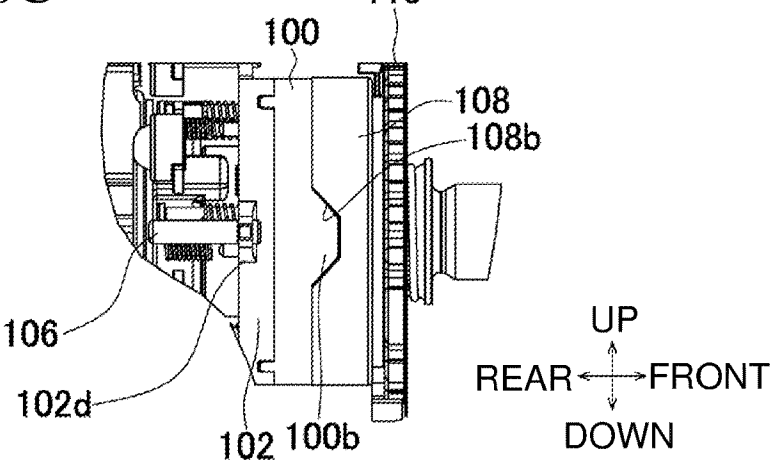
Figures 21A, 21B, 21C, 21D:
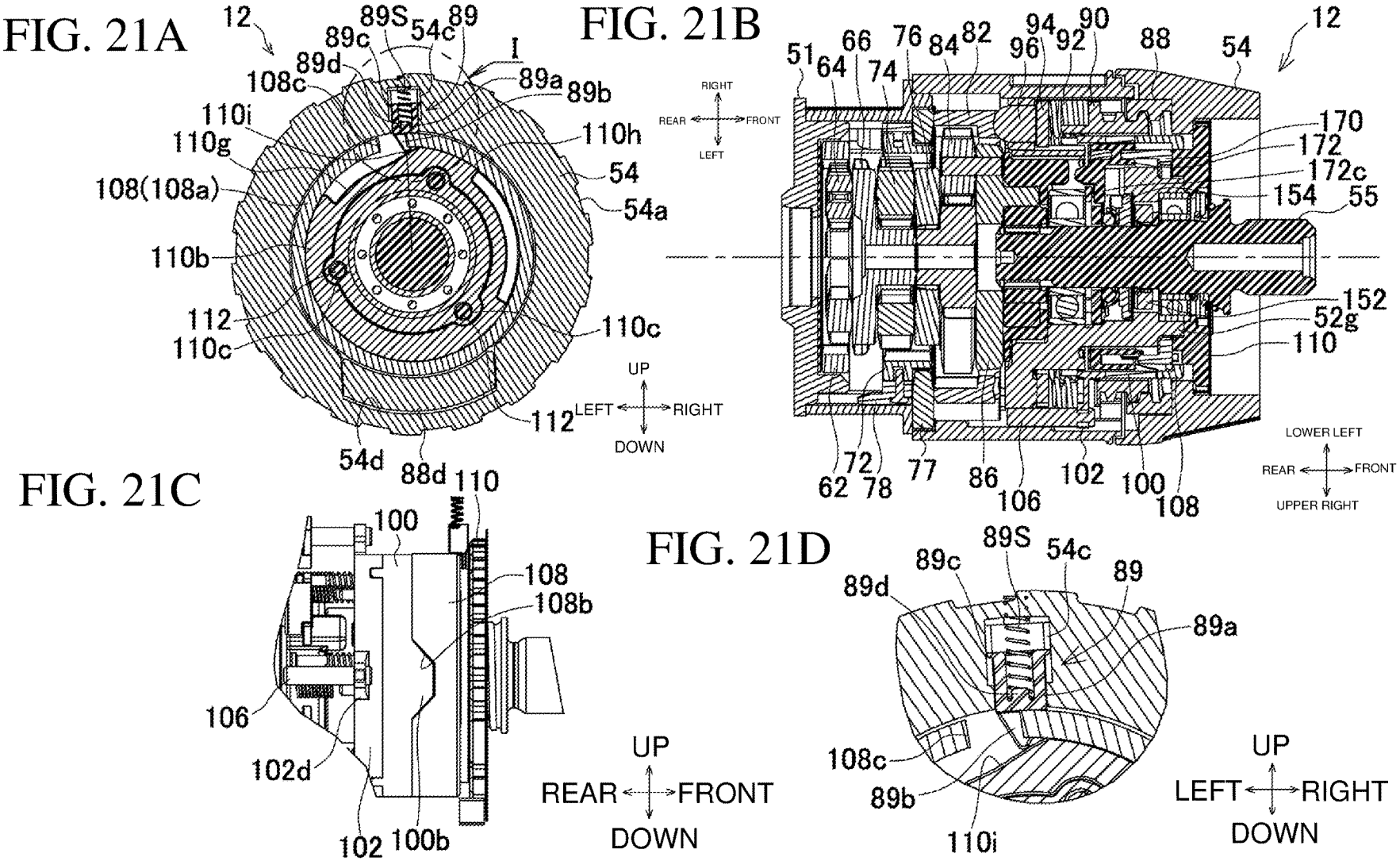
FIGS. 21A to 21C are diagrams similar to FIGS. 16A to 16C in an intermediate state between the clutch mode (with a maximum clutch setting) and the drill mode.
FIG. 21D is an enlarged view of an area I shown in FIG. 21A.

As shown in FIGS. 20A to 20C, when the change ring 54 is rotated until the middle portion of the leaf spring 87 is received in the notch 110*f* described above, the third internal gear 82 is no longer prevented from rotating by the internal gear lock pins 106, and is either regulated not to rotate or allowed to rotate by the clutch pins 96.

More specifically, each clutch pin 96 comes in contact with any of the cam projections 82*b* on the third internal gear 82, and regulates or allows rotation of the internal gear 82 in accordance with the elastic force of the clutch pin coil springs 92.

The clutch pins 96 press the front surface of the internal gear 82 in accordance with the elastic force of the clutch pin coil springs 92. At a torque less than a predetermined torque in accordance with the elastic force, the clutch pins 96 catch the cam projections 82*b* to lock the internal gear 82. Each cam projection 82*b* has a side surface including a rounded narrowed portion in correspondence with the rear end of the clutch pin 96. The clutch pins 96 in contact with the narrowed portions sufficiently resist a rotational force from the third internal gear 82. At the predetermined torque or more, the cam projections 82*b* move the clutch pins 96 forward against the elastic force and move over the clutch pins 96. The narrowed portions facilitate this movement over the clutch pins 96. The clutch pins 96 are passed over to allow rotation of the internal gear 82. Unless its rotation is prevented by other components, the internal gear 82 rotates and causes the carrier 86 (tab members 86*c*) to rotate without engagement, thus operating the clutch.

The vibration switch ring 170 is, together with the drill switch ring 108, retained at a rotational position corresponding to where the lock lever receiving recess 108*c* is located radially outward from the slope 110*i*. The vibration switch levers 172 are then moved rearward to retain the vibration switch ring 170 at a rotational position with no vibration generated.

More specifically, the vibration driver drill 1 at this rotational position becomes a clutch mode in which the clutch operates and no vibration is generated.

At this rotational position, the spring holder 90 is located rearmost to allow the clutch to operate through the engagement between the thread 90*b* and the thread 88*b* on the clutch switch ring 88 rotatable integrally with the change ring 54. In this state, the clutch pin coil springs 92, which urge the clutch pins 96 through the washer 94, are compressed most tightly to produce the largest urging force. Thus, the clutch operation torque (clutch setting torque) becomes the largest (clutch mode with a maximum clutch setting).

The vibration driver drill 1 includes multiple (twelve) clutch pin coil springs 92, rather than a single large clutch pin coil spring. This structure increases the spring constant and reduces the solid length compared with the structure using a single large coil spring. This structure is thus shorter in the front-rear direction. This structure may further include additional components between the clutch pin coil springs 92 without interrupting the operation of the clutch pin coil springs 92. The vibration driver drill 1 can thus be compact.

When the change ring 54 is rotated from the above rotational position until the middle portion of the leaf spring 87 is received in the next notch 110*f*, the follower 89*b* follows along the larger diameter portion 110*h*, and the lock lever base 89*a* passes radially outside the drill switch ring base 108*a*.

At this rotational position, the spring holder 90 moves forward, and the clutch pin coil springs 92 are expanded to reduce the urging force. This reduces the clutch setting torque (clutch mode with the second highest clutch setting).

When the change ring 54 is rotated further in the same direction until the middle portion of the leaf spring 87 is received in the farthest notch 110*f* (adjacent to the notch 110*d*), the spring holder 90 is located foremost to allow the clutch to operate. In this state, the clutch pin coil springs 92 are expanded most largely to urge the clutch pins 96 with the least urging force through the washer 94, causing the clutch setting torque to be the smallest (clutch mode with the minimum clutch setting).

As described above, changing the rotational position of the clutch switch ring 88 with the change ring 54 changes the position of the spring holder 90 in the front-rear direction. In this state, the distance between the flanges 90*c* and the washer 94 is changed to adjust the elastic force of the clutch pin coil springs 92. The washer 94 presses the clutch pins 96 through the clutch pin sleeves 95 in accordance with the elastic force of the clutch pin coil springs 92, and thus retains the third internal gear 82 with a torque corresponding to the elastic force.

When the change ring 54 rotates in the direction opposite to the above rotation direction, the above operation is reversed to cause the corresponding mode switching.

More specifically, in an intermediate state between the clutch mode (with the maximum clutch setting) and the drill mode (with the change ring 54 at the same rotational position as in FIGS. 19A to 19C), as shown in FIGS. 21A to 21D, the follower 89*b* may be out of contact from the slope 110*i* due to the shape of the slope 110*i*. This structure prevents unsuccessful rotation of the change ring 54 caused by the lock lever 89 incompletely caught by the lock lever receiving recess 108*c* (refer to FIG. 21D).

An example operation of the vibration driver drill 1 according to the present embodiment will now be described.

An operator holds the grip 6 and pulls the switch lever 8 to turn on the switch body 9 and powers the motor 10 from the battery 32, rotating the rotor 36 (motor shaft 37).

The motor shaft 37 rotates to rotate the fan 42. Air released through the air outlets 22*a* flows (blows) through the air inlets 20*c* to cool the mechanism including the motor 10 inside the housing 2.

The rotational force on the motor shaft 37 is reduced by the gear assembly 12 including the three-stage reduction mechanism, before transmitted to the spindle 55 and to a bit such as a drill or a screwdriver attached to the chuck 14.

The middle planetary gear mechanism 70 in the gear assembly 12 operates either in the high speed mode or the low speed mode in accordance with the position of the speed switch lever 79.

The mode can be selected from three operational modes and the clutch setting torque in the clutch mode can be selected in accordance with the rotational position of the change ring 54.

More specifically, the vibration mode is selected when the change ring 54 is at a rotational position corresponding to the notch 110*d*. In the vibration mode, the vibration switch levers 172 lock the second vibration cam 154 in a nonrotatable manner, and the rotating spindle 55 moves rearward to cause the first cam surface 152*b* to rub against the second cam surface 154*b*, thus axially vibrating the spindle 55.

The drill mode is selected when the change ring 54 is at a rotational position corresponding to the notch 110*e*. In the drill mode, the internal gear 82 in the front planetary gear mechanism 80 is locked and the second vibration cam 154 is allowed to rotate, without operating the clutch and generating vibrations. In the drill mode, the spindle 55 rotates, without the clutch being disengaged. The spindle 55 continues rotating independently of a load on the spindle 55 for drilling using a drill bit attached by the operator.

The clutch mode is selected when the change ring 54A is at a rotational position corresponding to the notch 110*f*. In the clutch mode, the front planetary gear mechanism 80 rotates without engagement, and disengages the clutch (stops transmitting torque) when a torque corresponding to the rotational position of the change ring 54 is applied to the spindle 55. A screw is fastened with a screwdriver bit until a large torque causes the spindle 55 to rotate without engagement. This completes the fastening of the screw.

The vibration driver drill 1 according to the present embodiment includes the motor 10, the external gear 76*c* driven by the motor 10, the planetary gears 84 driven by the external gear 76*c*, the internal gear 82 meshing with the planetary gears 84, the internal gear lock pins 106 movable forward and rearward relative to the internal gear 82 to lock the internal gear 82 in a nonrotatable manner at a forward position, the spindle 55 driven by the planetary gears 84, the gear housing 52 accommodating the planetary gears 84, the first vibration cam 152 fixed to the spindle 55, the second vibration cam 154 that rubs against the first vibration cam 152 and rotatable relative to the gear housing 52, the vibration switch levers 172 movable forward and rearward relative to the second vibration cam 154 to lock the second vibration cam 154 in a nonrotatable manner at a forward position, and the annular change ring 54 that switches between forward movement and rearward movement of the internal gear lock pins 106 and switches between forward movement and rearward movement of the vibration switch levers 172. The single change ring 54 allows switching of the clutch (movement of the internal gear lock pins 106 between forward and rearward), and switching of vibration (movement of the vibration switch levers 172 between forward and rearward), enabling easy operation.

The vibration driver drill 1 further includes the pin holder 102 holding the internal gear lock pins 106. The support ring 100 connected to the pin holder 102 includes the cam projections 100*b* (pin holder cams) for moving the internal gear lock pins 106 forward and rearward relative to the internal gear 82 when the change ring 54 is at a predetermined rotational position. Thus, a mechanism for switching the clutch (for moving the internal gear lock pins 106 forward and rearward) is smoothly operable and simple.

Further, the vibration switch levers 172 include the raised portions 172*b* (vibration switch cams) for moving the vibration switch levers 172 forward and rearward relative to the second vibration cam 154 when the change ring 54 is at a predetermined rotational position. Thus, the vibration driver drill 1 includes a mechanism for switching vibration (for moving the vibration switch levers 172 forward and rearward) that is smoothly operable and simple.

The vibration driver drill 1 according to the present embodiment includes the motor 10, the external gear 76*c* driven by the motor 10, the planetary gears 84 driven by the external gear 76*c*, the internal gear 82 meshing with the planetary gears 84, the clutch pin coil springs 92, the clutch pins 96 that come in contact with the internal gear 82 when urged by the clutch pin coil springs 92 to lock the internal gear 82 in a nonrotatable manner in accordance with the urging force of the clutch pin coil springs 92, the spring holder 90 holding the clutch pin coil springs 92 to allow the clutch pin coil springs 92 to generate a variable urging force, the spindle 55 driven by the planetary gears 84, the gear housing 52 accommodating the planetary gears 84, the first vibration cam 152 fixed to the spindle 55, the second vibration cam 154 that rubs against the first vibration cam 152 and rotatable relative to the gear housing 52, the vibration switch levers 172 movable forward and rearward relative to the second vibration cam 154 to lock the second vibration cam 154 in a nonrotatable manner at a forward position, and the annular change ring 54 that switches the urging force of the clutch pin coil springs 92 held by the spring holder 90 and switches between forward movement and rearward movement of the vibration switch levers 172. In the vibration driver drill 1, the single change ring 54 allows switching of the clutch setting torque (the urging force of the clutch pin coil springs 92 held by the spring holder 90) and switching of vibration (movement of the vibration switch levers 172 between forward and rearward), enabling easy operation.

The vibration driver drill 1 further includes the internal gear lock pins 106 movable forward and rearward relative to the internal gear 82 to lock the internal gear 82 in a nonrotatable manner at a forward position, the pin holder 102 holding the internal gear lock pins 106, the drill switch ring 108 that switches between forward movement and rearward movement of the internal gear lock pins 106 relative to the internal gear 82 through the pin holder 102 in response to rotation transmitted from the change ring 54, and the lock lever 89 that enables and disables transmission of the rotation of the change ring 54 to the drill switch ring 108. Thus, a mechanism for switching the clutch setting torque (the urging force of the clutch pin coil springs 92 held by the spring holder 90) is smoothly operable and simple.

The drill switch ring 108 has the lock lever receiving recess 108*c*. The lock lever 89 is located in the change ring 54 to be receivable in the lock lever receiving recess 108*c*. The lock lever 89 enters the lock lever receiving recess 108*c* to enable transmission of the rotation of the change ring 54 to the drill switch ring 108. In the clutch mode, the drill switch ring 108 is disengaged from the change ring 54 to retain the internal gear 82 unlocked. In the switching between the drill mode and the vibration mode, the drill switch ring 108 is engaged with the change ring 54 to integrally rotate to reliably lock the internal gear 82. This simple mechanism allows smooth operation.

The second vibration cam 154 includes the tabs 154*c*. The vibration switch levers 172 each include the vibration switch tab 172*c*. The tabs 154*c* are catchable by the vibration switch tabs 172*c* to lock the second vibration cam 154 in a nonrotatable manner. Thus, the vibration mechanism is smoothly operable and simple.

The vibration driver drill 1 according to the present embodiment includes the external gear 76*c*, the planetary gears 84 meshing with the external gear 76*c*, the internal gear 82 meshing with the planetary gears 84, the spindle 55 connected to the planetary gears 84, the clutch pin coil springs 92 that urge the internal gear 82, the first vibration cam 152 and the second vibration cam 154 that axially vibrate the spindle 55, the internal gear lock pins 106 that lock the internal gear 82 in a nonrotatable manner, and the change ring 54 connected to the clutch pin coil springs 92, the first vibration cam 152 and the second vibration cam 154, and the internal gear lock pins 106.

The single change ring 54 allows the control of the clutch pin coil springs 92, the first vibration cam 152 and the second vibration cam 154, and the internal gear lock pins 106, enabling easy operation.

Embodiments and modifications of the present invention are not limited to the above embodiments and modifications, and may be modified as appropriate as described below.

The recesses and the protrusions on the cam components may be reversed. For example, the vibration switch levers 172 may have the cam recesses 170*c*, and the vibration switch ring 170 may have the raised portions 172*b*. Further, the cam components may be driven with parts other than the recesses and the protrusions.

Intermediate components between the components, for example, the support ring 100 between the drill switch ring 108 and the pin holder 102, may be eliminated. Additional intermediate components may be located between the components.

The rotational axis of the change ring 54 may not be coaxial with the spindle 55 (output shaft). The change ring 54 may be replaced with a change lever movable to cause mode switching.

The clutch mechanism 97 may be an electronic clutch. The vibration mechanism 150 may generate vibrations electrically. The vibration mechanism 150 may be eliminated to provide an electric driver drill with no vibration mode. The clutch mechanism 97 may be eliminated to provide a vibration drill with no clutch mode. The drill mode may be eliminated to provide a vibration driver with no drill mode.

The pin holding members 102*d* may hold the internal gear lock pins 106 in a different manner, such as press fitting of a projection into a hole. The manner for holding or press fitting may be modified as appropriate.

The fan 42 may be arranged in front of the stator 35.

The battery 32 may be a lithium-ion battery of 18 to 36 V including 14.4 V, 18 V (20 V at the maximum), 18 V, 25.2 V, 28 V, and 36 V, or may be a lithium-ion battery of less than 10.8 V or greater than 36 V, or may be another battery. Two or more batteries 32 may be used. Such multiple batteries 32 may be connected either in series or in parallel, or some of the batteries 32 may be connected in series and the others may be connected in parallel.

The gear housing 52 may be held inside the body housing 20.

At least the number of sections in the housing 2, planetary gears, stages of a reduction mechanism, balls in the components, the rollers 130, protrusions on the components (for example, protrusions, protruding pieces, and protruding portions), pins on the components, springs of the components, or screws for the components may be smaller or greater than the number described above. Each component may be formed from another material. For example, the balls may be formed from a resin instead of steel. The type of each operational part, such as the switch type of the switch lever 8, may be changed. Each component or member may be arranged in a different manner. For example, the spring holder 90 in the clutch mechanism 97 may be arranged radially inward from the pin holder 102 for locking the internal gear 82. Each component may have another shape. For example, the follower 89*b* in the lock lever 89 may be trapezoidal.

The present invention may be applicable to an angle power tool including an output shaft (tip tool holder) in a direction different (about 90 degrees) from the direction of a power unit (at least either the direction of the motor shaft 37 of the motor 10 or the transmission direction of rotation from the motor shaft 37 by a transmission mechanism).

The present invention may be applicable to non-chargeable (non-battery driven) tools powered by utility power including a vibration driver drill, other power tools, a cleaner, a blower, and a gardening tool such as a gardening trimmer.

REFERENCE SIGNS LIST

1 electric vibration driver drill (power tool)
10 motor
52 gear housing
54 change ring
55 spindle
76*c* external gear (sun gear)
82 internal gear
84 planetary gear
89 lock lever (locking member)
90 spring holder (elastic member holder)
92 clutch pin coil spring (clutch pin elastic member or elastic member)
96 clutch pin
100 support ring (a member connectable to a pin holder)
100*b* cam projection (pin holder cam)
102 pin holder
106 internal gear lock pin
108 drill switch ring
108*c* lock lever receiving recess (locking member receiving recess)
152 first vibration cam (vibration cam)
154 second vibration cam (vibration cam)
154*c* tab
172 vibration switch lever (vibration switch member)
172*b* raised portion (vibration switch cam)
172*c* vibration switch tab

What is claimed is:

1. A power tool, comprising:
a motor;
a sun gear driven by the motor;
a planetary gear driven by the sun gear;

an internal gear meshing with the planetary gear;

an internal gear lock pin movable forward and rearward relative to the internal gear and configured to lock the internal gear in a nonrotatable manner at a forward position;

a spindle driven by the planetary gear;

a gear housing accommodating the planetary gear;

a first vibration cam fixed to the spindle;

a second vibration cam configured to rub against the first vibration cam and rotatable relative to the gear housing;

a vibration switch lever movable forward and rearward relative to the second vibration cam and configured to lock the second vibration cam in a nonrotatable manner at a forward position;

an annular change ring configured to switch between forward movement and rearward movement of the internal gear lock pin and to switch between forward movement and rearward movement of the vibration switch lever;

a pin holder holding the internal gear lock pin; and a pin holder cam configured to move the internal gear lock pin forward and rearward relative to the internal gear when the change ring is at a predetermined rotational position.

2. The power tool according to claim 1, wherein the pin holder cam is included in the pin holder or a member connected to the pin holder.

3. The power tool according to claim 1, further comprising:

a vibration switch cam configured to move the vibration switch lever forward and rearward relative to the second vibration cam when the change ring is at a predetermined rotational position.

4. A power tool, comprising:

a motor;

a sun gear driven by the motor;

a planetary gear driven by the sun gear;

an internal gear meshing with the planetary gear;

an internal gear lock pin movable forward and rearward relative to the internal gear and configured to lock the internal gear in a nonrotatable manner at a forward position;

a spindle driven by the planetary gear;

a gear housing accommodating the planetary gear;

a first vibration cam fixed to the spindle;

a second vibration cam configured to rub against the first vibration cam and rotatable relative to the gear housing;

a vibration switch lever movable forward and rearward relative to the second vibration cam and configured to lock the second vibration cam in a nonrotatable manner at a forward position;

an annular change ring configured to switch between forward movement and rearward movement of the internal gear lock pin and to switch between forward movement and rearward movement of the vibration switch lever; and a vibration switch cam configured to move the vibration switch lever forward and rearward relative to the second vibration cam when the change ring is at a predetermined rotational position.

5. The power tool according to claim 4, wherein the vibration switch cam is included in the vibration switch lever or a member connected to the vibration switch lever.

6. A power tool, comprising:

a motor;

a sun gear driven by the motor;

a planetary gear driven by the sun gear;

an internal gear meshing with the planetary gear;

an internal gear lock pin movable forward and rearward relative to the internal gear and configured to lock the internal gear in a nonrotatable manner at a forward position;

a spindle driven by the planetary gear;

a gear housing accommodating the planetary gear;

a first vibration cam fixed to the spindle;

a second vibration cam configured to rub against the first vibration cam and rotatable relative to the gear housing;

a vibration switch lever movable forward and rearward relative to the second vibration cam and configured to lock the second vibration cam in a nonrotatable manner at a forward position;

an annular change ring configured to switch between forward movement and rearward movement of the internal gear lock pin and to switch between forward movement and rearward movement of the vibration switch lever;

a clutch pin elastic member;

a clutch pin configured to come in contact with the internal gear when urged by the clutch pin elastic member to retain the internal gear in a nonrotatable manner in accordance with an urging force of the clutch pin elastic member; and an elastic member holder holding the clutch pin elastic member to allow the clutch pin elastic member to generate a variable urging force;

wherein the annular change ring switches the urging force of the clutch pin elastic member held by the elastic member holder.

7. The power tool according to claim 6, further comprising:

a pin holder holding the internal gear lock pin;

a drill switch ring configured to switch between forward movement and rearward movement of the internal gear lock pin relative to the internal gear through the pin holder in response to rotation transmitted from the change ring; and a locking member configured to enable and disable transmission of the rotation of the change ring to the drill switch ring.

8. The power tool according to claim 7, wherein the drill switch ring has a locking member receiving recess, the locking member is located in the change ring to be receivable in the locking member receiving recess, and the locking member enters the locking member receiving recess to enable transmission of the rotation of the change ring to the drill switch ring.

9. The power tool according to claim 6, wherein the power tool comprises a plurality of the clutch pin elastic members.

10. The power tool according to claim 6, wherein the second vibration cam includes a tab, the vibration switch lever includes a vibration switch tab, and the tab is catchable by the vibration switch tab to lock the second vibration cam in a nonrotatable manner.

11. A power tool, comprising:

a motor;

a sun gear driven by the motor;

a planetary gear driven by the sun gear;

an internal gear meshing with the planetary gear;

an internal gear lock pin movable forward and rearward relative to the internal gear and configured to lock the internal gear in a nonrotatable manner at a forward position;

a spindle driven by the planetary gear;

a gear housing accommodating the planetary gear;

a first vibration cam fixed to the spindle;

a second vibration cam configured to rub against the first vibration cam and rotatable relative to the gear housing;

a vibration switch lever movable forward and rearward relative to the second vibration cam and configured to lock the second vibration cam in a nonrotatable manner at a forward position; and an annular change ring configured to switch between forward movement and rearward movement of the internal gear lock pin and to switch between forward movement and rearward movement of the vibration switch lever, wherein the second vibration cam includes a tab, the vibration switch lever includes a vibration switch tab, and the tab is catchable by the vibration switch tab to lock the second vibration cam in a nonrotatable manner.

12. The power tool according to claim 11, wherein the power tool comprises a plurality of the clutch pin elastic members.

* * * * *